US011428144B2

(12) United States Patent
Cavataio et al.

(10) Patent No.: US 11,428,144 B2
(45) Date of Patent: Aug. 30, 2022

(54) ENGINE EMMISSIONS CONTROL METHODS AND SYSTEMS

(71) Applicant: Ford Global Technologies, LLC, Dearborn, MI (US)

(72) Inventors: Giovanni Cavataio, Dearborn, MI (US); Michael Uhrich, Wixom, MI (US); Jason Wu, Birmingham, MI (US); Andrew Getsoian, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/079,898

(22) Filed: Oct. 26, 2020

(65) Prior Publication Data

US 2022/0127995 A1 Apr. 28, 2022

(51) Int. Cl.

| | |
|---|---|
| ***F01N 3/00*** | (2006.01) |
| ***F01N 11/00*** | (2006.01) |
| ***F01N 3/20*** | (2006.01) |

(52) U.S. Cl.

CPC ..... *F01N 11/007* (2013.01); *F01N 3/2066* (2013.01); *F01N 11/002* (2013.01); *F01N 2370/04* (2013.01); *F01N 2550/02* (2013.01); *F01N 2560/021* (2013.01); *F01N 2560/025* (2013.01); *F01N 2560/026* (2013.01); *F01N 2900/1404* (2013.01); *F01N 2900/1624* (2013.01)

(58) Field of Classification Search

CPC .... F01N 11/007; F01N 11/002; F01N 3/2066; F01N 2560/021; F01N 2370/04; F01N 2900/1624; F01N 2560/025; F01N 2900/1404; F01N 2560/026; F01N 2550/02

See application file for complete search history.

(56) References Cited

U.S. PATENT DOCUMENTS

| | | | | |
|---|---|---|---|---|
| 9,261,007 | B2 * | 2/2016 | Aoki | F01N 11/007 |
| 2009/0018702 | A1 | 1/2009 | Oakes | |
| 2010/0005873 | A1 * | 1/2010 | Katoh | F01N 3/0842 73/114.75 |
| 2012/0191288 | A1 * | 7/2012 | Qi | F01N 3/0814 701/29.1 |
| 2014/0144125 | A1 * | 5/2014 | Cavataio | F01N 3/101 60/274 |
| 2016/0237875 | A1 * | 8/2016 | Hagiwara | F02D 41/0235 |
| 2017/0167352 | A1 * | 6/2017 | Hagiwara | F01N 3/2066 |
| 2018/0094558 | A1 * | 4/2018 | Hagimoto | F01N 3/208 |
| 2018/0283302 | A1 * | 10/2018 | Hayashita | F01N 3/2066 |
| 2019/0271248 | A1 * | 9/2019 | Umemoto | F01N 3/2006 |

* cited by examiner

*Primary Examiner* — Matthew T Largi

(74) *Attorney, Agent, or Firm* — Vincent Mastrogiacomo; McCoy Russell LLP

(57) ABSTRACT

Methods and systems are provided for operating an engine of a vehicle. In one example, a method may include positioning an oxygen sensor in an engine exhaust downstream from a selective catalytic reduction (SCR) catalyst, determining an oxygen storage capacity of the SCR catalyst based on a measurement of the oxygen sensor, and determining an extent of deactivation of the SCR catalyst based on the oxygen storage capacity.

20 Claims, 10 Drawing Sheets

ENGINE EMMISSIONS CONTROL METHODS AND SYSTEMS

FIELD

The present description relates generally to methods and systems of determining an extent of deactivation in a selective catalyst reduction (SCR) catalyst in an engine exhaust system.

BACKGROUND/SUMMARY

It is becoming increasingly difficult to increase performance of three-way catalysts (TWC's) in engine exhaust systems to meet lower tailpipe emission standards such as SULEV 10-20. To meet engine power demands, engines are operating more frequently and/or under richer air-to-fuel conditions, resulting in higher emissions of $NH_3$. Furthermore, switching off fuel to the engine during deceleration and start-top engine events to reduce fuel consumption can give rise to increased NOx emissions. Engine exhaust systems can include SCR catalysts to reduce emissions from the engine exhaust. For example, SCR catalysts can capture and mitigate NOx and $NH_3$ breakthrough in the exhaust stream during transient fuel shutoff (TFSO) and engine start-stop events. However, during certain conditions, the SCR can also be deactivated, thereby losing its ability to adsorb $NH_3$ and convert NOx in the exhaust. As such, reliable diagnostic methods to detect SCR catalyst deactivation can aid in decreasing exhaust emissions.

In one approach, NOx/$NH_3$ sensors are positioned in the engine exhaust downstream from the SCR catalyst to measure NOx/$NH_3$ breakthrough from the SCR catalyst, whereby detection of NOx/$NH_3$ breakthrough from the SCR catalyst provides an indication SCR catalyst deactivation. However, the inventors herein have recognized potential issues with such systems. NOx/$NH_3$ sensors are expensive, and increase costs of vehicle manufacture, operation, and maintenance.

In one example, the issues described above may be at least partially addressed by a method of operating an engine comprising, positioning an oxygen sensor in an engine exhaust downstream from a selective catalytic reduction (SCR) catalyst, determining an oxygen storage capacity of the SCR catalyst based on a measurement of the oxygen sensor, and determining an extent of deactivation of the SCR catalyst based on the oxygen storage capacity. In this way, the technical effect of reliably diagnosing SCR catalyst deactivation can be achieved, while reducing exhaust emissions and reducing vehicle costs.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
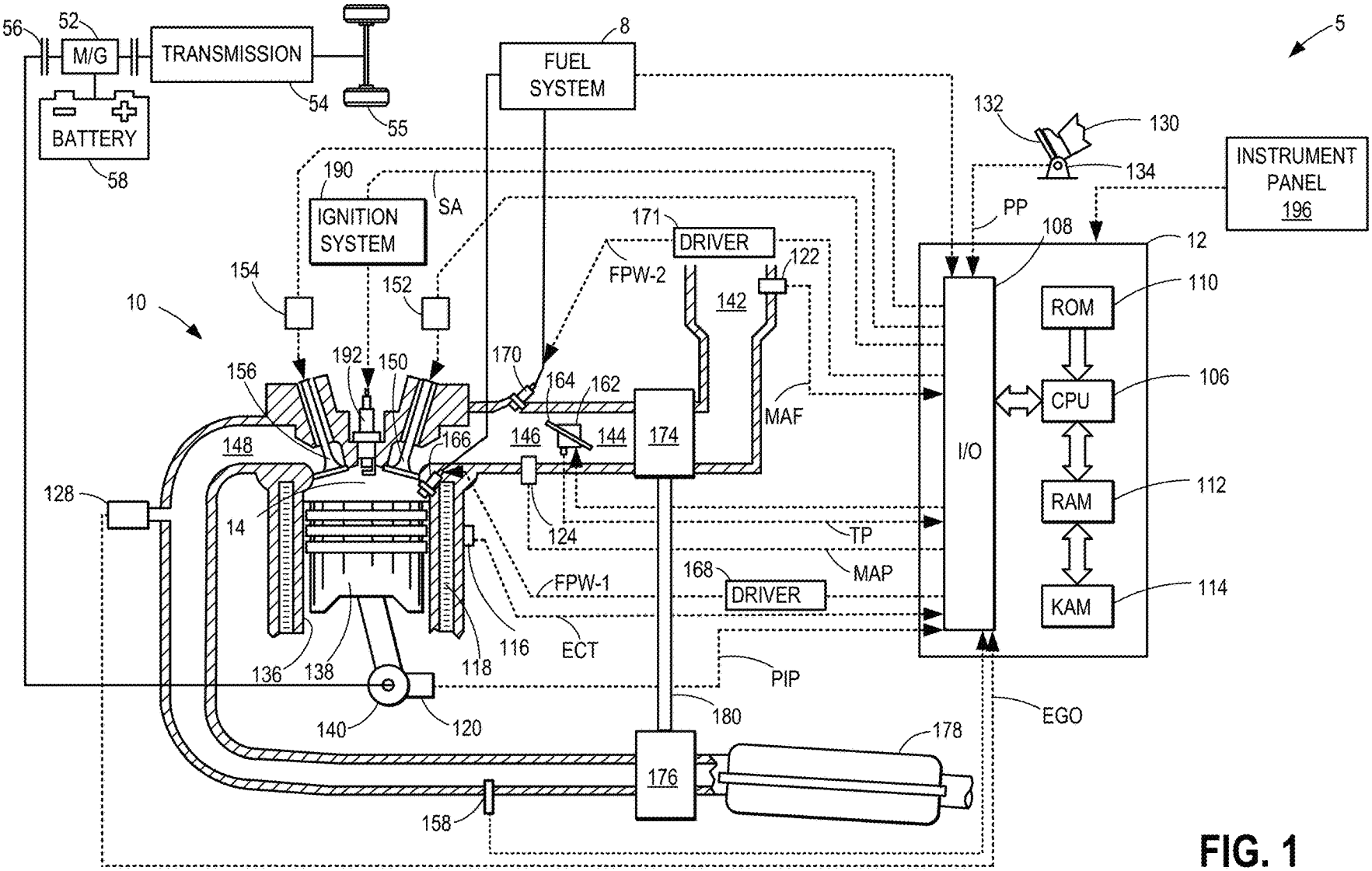
FIG. 1 shows a schematic of an example engine system of a vehicle, including an emissions control device (ECD).
Figure 2:
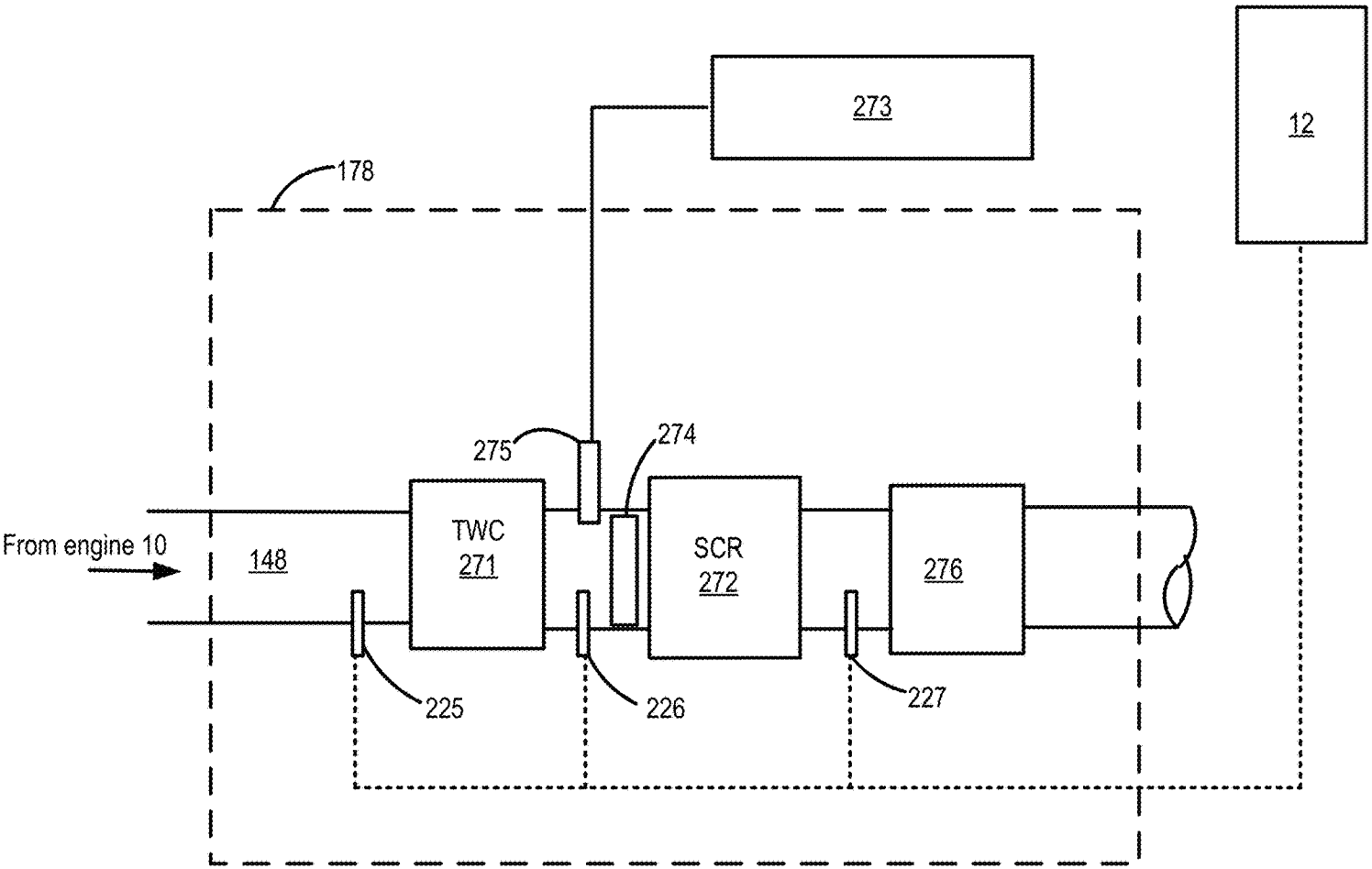
FIG. 2 shows a detailed schematic of the ECD of FIG. 1, including an SCR catalyst.
Figure 3:
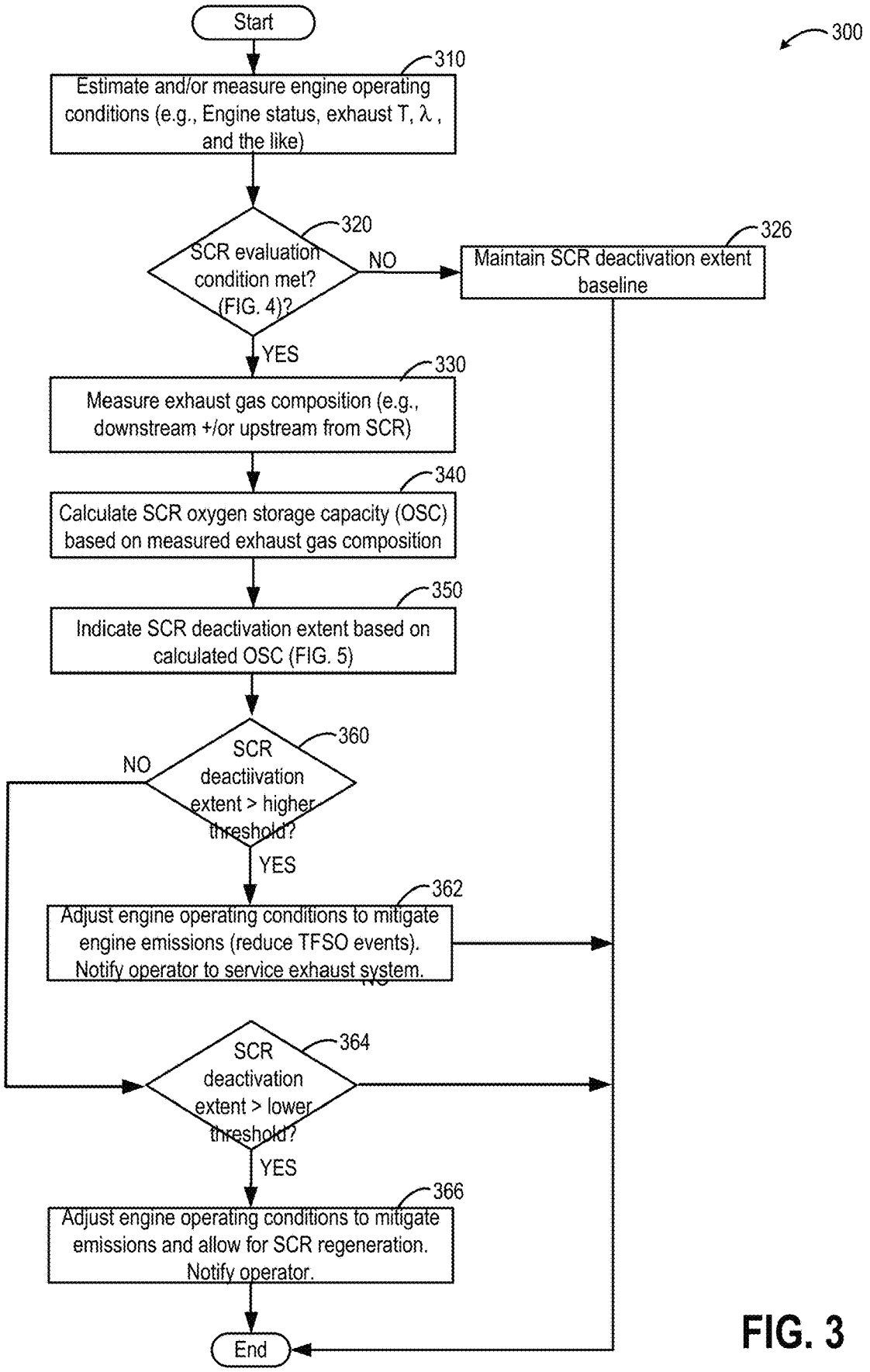
FIGS. 3-5 show flowcharts for an example method of operating the engine system of FIG. 1.
Figure 4:
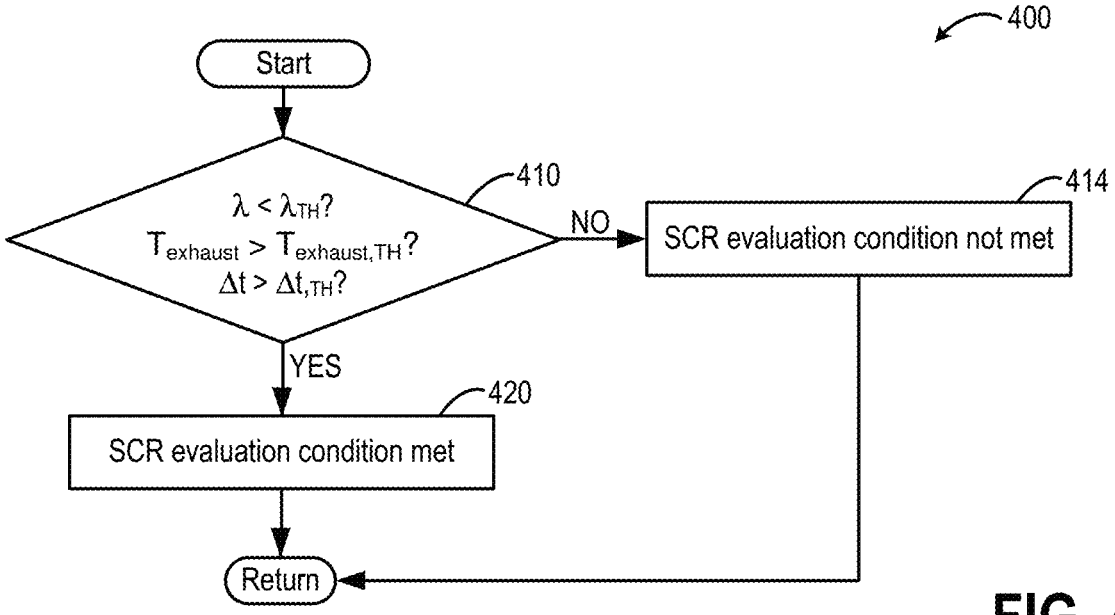
Figure 5:
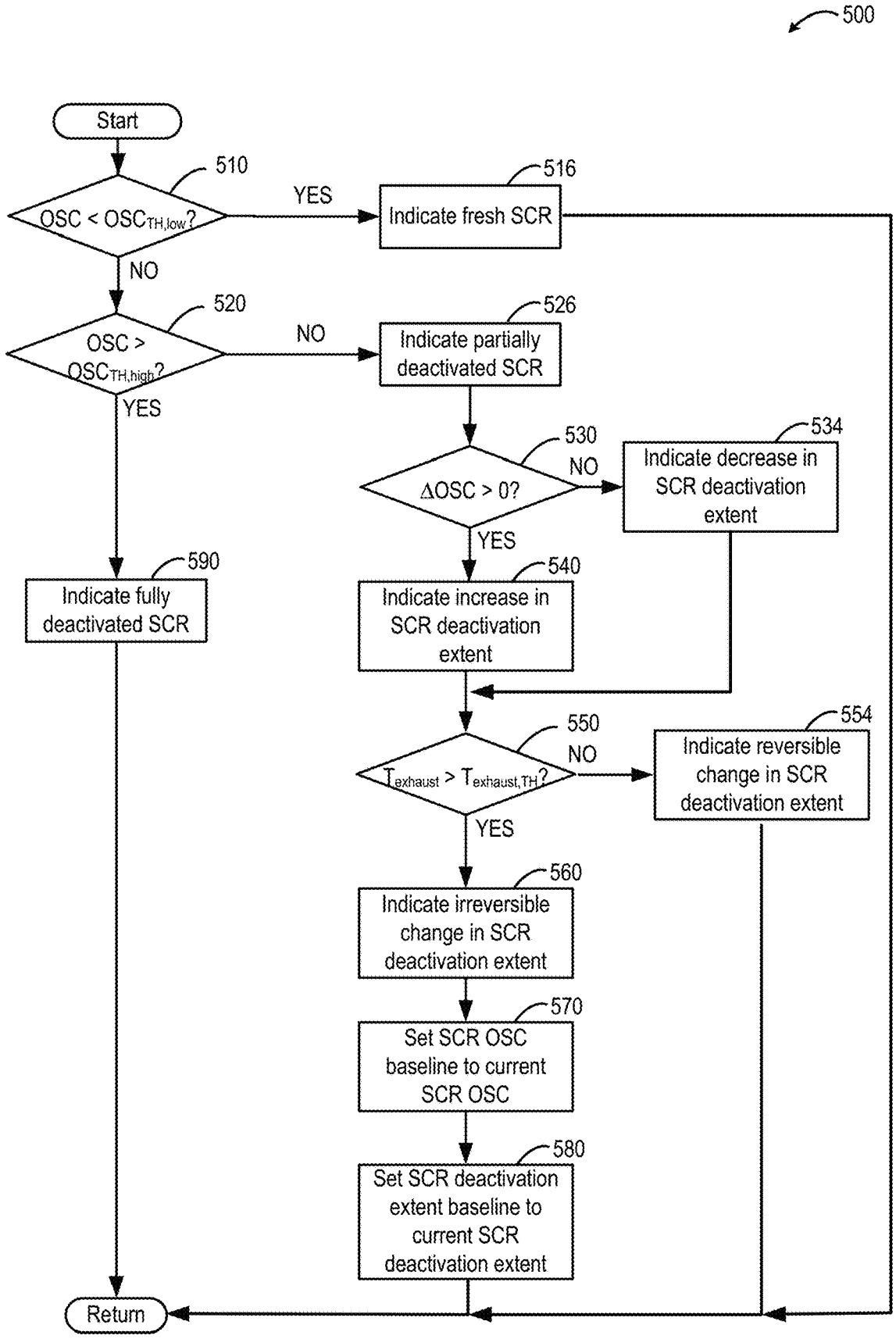
Figure 6:
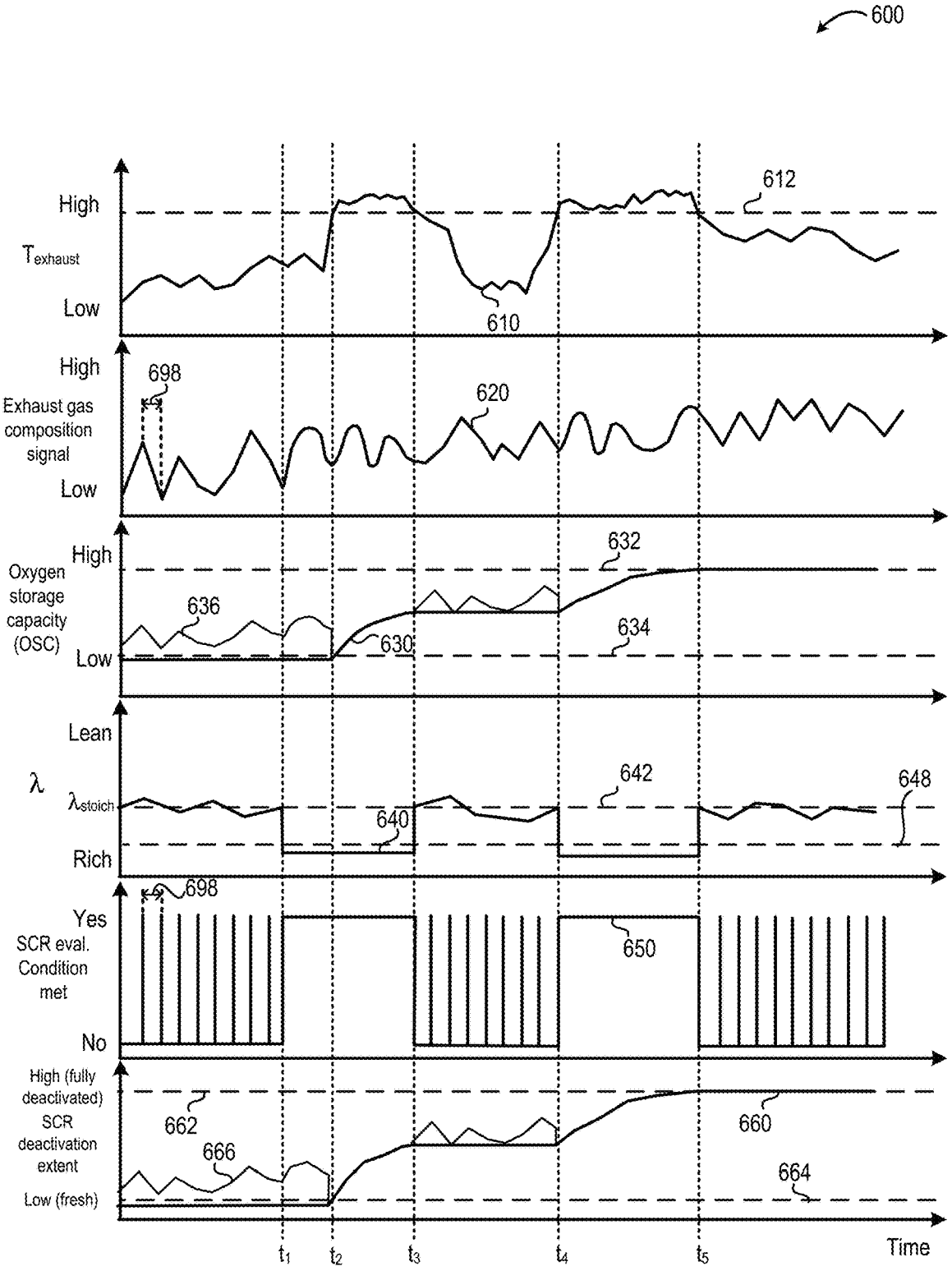
FIG. 6 shows an example timeline for operating the engine system of FIG. 1 according the method of FIGS. 3-5.
Figure 12:
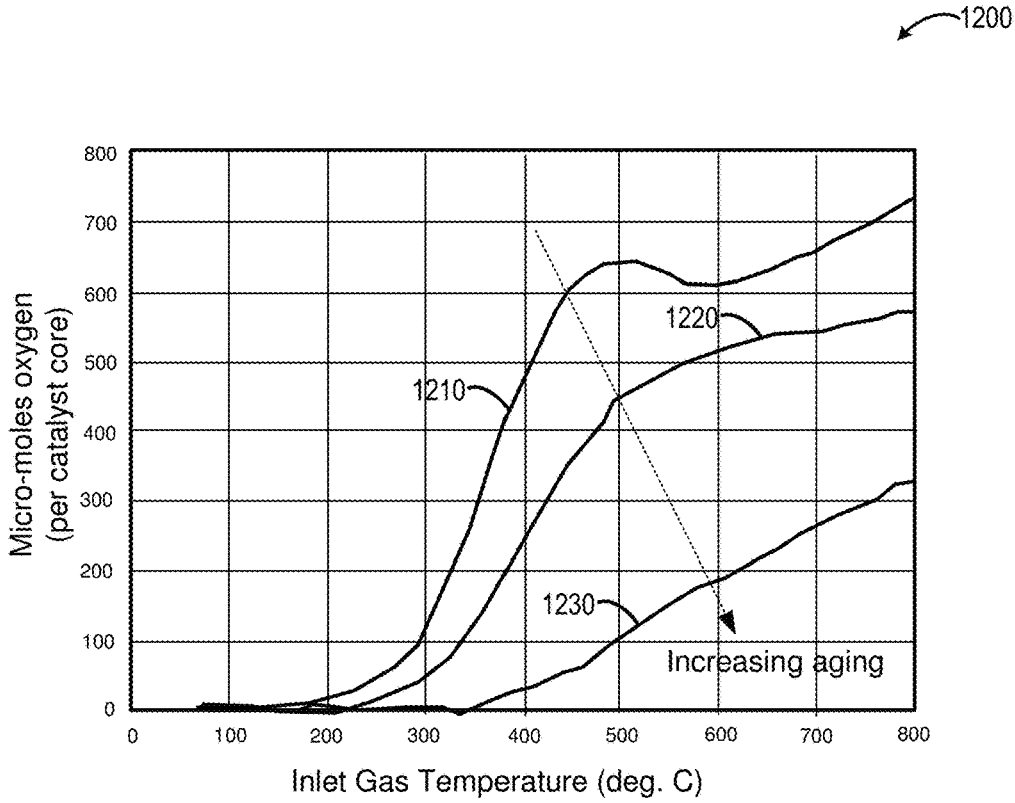
FIG. 12 shows an example plot illustrating monitoring of a TWC catalyst of the ECD of FIG. 2 during operation of the engine system of FIG. 1.
Figure 13:
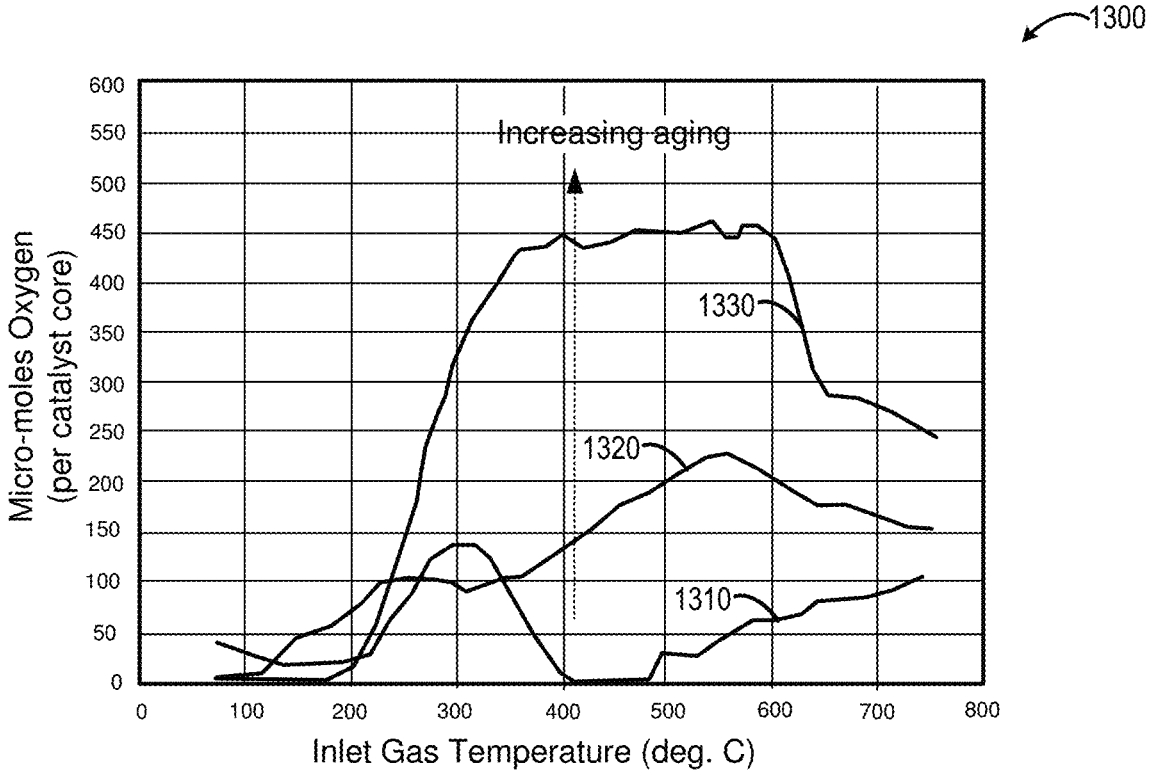
FIG. 13 shows an example plot illustrating monitoring of the SCR catalyst of the ECD of FIG. 2 during operation of the engine system of FIG. 1.

The following description relates to systems and methods for operating an engine system of a vehicle, such as the engine system of FIG. 1. In particular, the systems and methods herein relate to determining an extent of deactivation of a selective catalyst reduction (SCR) catalyst positioned downstream from a three-way catalyst (TWC) in an engine exhaust system, as shown in FIGS. 1 and 2. The method for determining the extent of deactivation of a SCR catalyst is shown generically by the flow chart in FIG. 3, and specific embodiments of the method are illustrated by the flow charts in FIGS. 4-5. An example timeline of operating an engine system according to the methods of FIGS. 3-5 is depicted in FIG. 6. SCR deactivation and aging characteristics are illustrated by the schematics and plots of FIGS. 7-11. Monitoring of the exhaust system components is illustrated by the plots of FIGS. 12-13.

Turning now to the figures, FIG. 1 depicts an example embodiment of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may include one or more of a three-way catalyst (TWC), a NOx trap, a selective catalyst reduction (SCR) catalyst, a diesel particulate filter (DPF), various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in intake passage 146 rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed. In an alternative embodiment, the vehicle instrument panel 196 may communicate audio messages to the operator without display. In another example, the vehicle instrument panel may also display an SCR deactivation extent. The SCR deactivation extent may be available to a vehicle operator and/or service technician as a data plot showing historical and current data, or as a displayed numerical representation indicating the current % life (100−% SCR deactivation extent) of the SCR catalyst remaining.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 receives signals from the various sensors of FIGS. 1 and 2 and employs the various actuators of FIG. 1 to adjust engine operation based on the received signals and instructions stored on a memory of the controller. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158. Furthermore, controller 12 may receive signals from exhaust gas composition sensors 225, 226, and 227 positioned at ECD 178 including upstream and/or downstream from SCR catalyst 272.

Furthermore, as further described herein, signals received at controller 12 from one or more of exhaust gas sensors 225, 226, and 227 coupled to ECD 178 may be utilized to determine an oxygen storage capacity (OSC) and/or a SCR deactivation extent of one or more devices of ECD 178. Subsequently, engine operation may be adjusted to mitigate exhaust emissions responsive to the calculated OSC and/or SCR deactivation extent. For example, if the SCR deactivation extent is greater than an upper threshold deactivation extent, the controller 12 may notify the vehicle operator to recommend servicing the ECD, and may adjust an engine operation to reduce a number and/or frequency of TFSO and/or engine start-stop events, in order to reduce NOx and/or $NH_3$ breakthrough at the SCR catalyst. In another example, responsive to the SCR deactivation extent being greater than an upper threshold deactivation extent, the controller 12 may reduce an active control to operate the engine with a rich air-to-fuel ratio at the TWC, thereby generating less $NH_3$; since the SCR deactivation extent is greater than the upper threshold deactivation extent, the ability of the SCR to adsorb $NH_3$ is reduced. Reducing the active control to operate the engine with a rich air-to-fuel ratio at the TWC may include disabling or turning OFF the active control to operate the engine with a rich air-to-fuel ratio at the TWC; in other words, engine operation resulting in a rich exhaust air-to-fuel ratio at the TWC may be reduced, and/or stopped.

The upper threshold deactivation extent may be a non-zero positive number and may correspond to a fully (e.g., 100%) deactivated SCR catalyst. In another case, the upper threshold deactivation extent may correspond to 90% deactivated SCR catalyst. In another example, if the SCR deactivation extent is below a lower threshold SCR deactivation extent, the controller 12 may display a notification to the vehicle operator that the SCR catalyst is in a fresh state. As an example, the lower threshold SCR deactivation extent may be a non-zero positive number and may correspond to a 1% SCR deactivation extent.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

During normal vehicle operation, reducing engine exhaust emissions may be balanced with other engine operational objectives, such as meeting engine power demands, and reducing fuel economy. More frequent and/or richer engine operation (e.g., lower air-to-fuel ratios) can aid in supplying increased engine power, and in promoting NOx conversion over a TWC, but can also increase emissions of ammonia ($NH_3$). TFSO and engine start-stop events, while economizing fuel, can increase NOx emissions because the engine is activated while the TWC is in an oxidized state, and thereby partially deactivated. Positioning an SCR catalyst downstream of the TWC in an exhaust passage can aid in reducing $NH_3$ and NOx emissions. The $NH_3$ generated at the TWC can be adsorbed at the surface of the SCR catalyst, and the adsorbed $NH_3$, in turn can reduce the NOx breakthrough from TFSO and engine start-stop events.

The three-way catalyst can become oxidized and deactivated upon exposure to air at temperatures above 600 degrees Celsius, such as during engine operation with restricted fuel flow (e.g., TFSO, engine start-stop). Following deactivation, the oxidized TWC undergoes reactivation under rich (e.g., air-to-fuel ratio less than 1) conditions. Current TWC formulations include cerium-zirconia oxide (CZO). During engine operation, the cerium component of the CZO can undergo a redox reaction, transitioning between two oxidation states, $Ce^{3+}$ (reduced state) and $Ce^{4+}$ (oxidized state), as shown in equation (1).

$$(Ce^{3+},\text{reduced state})Ce_2O_3 \leftrightarrow 2CeO_2(Ce^{4+},\text{oxidized state}) \quad (1)$$

Operating the engine rich will reduce the $Ce^{4+}$ to $Ce^{3+}$, while operating the engine lean (e.g., air-to-fuel ratio greater than 1) will oxidize the $Ce^{3+}$ to $Ce^{4+}$. As shown by equation (1), the $Ce^{4+}$ oxidized state binds four oxygen atoms, while the $Ce^{3+}$ reduced state binds three oxygen atoms. In this way, the TWC can exhibit an oxygen storage capacity (OSC), whereby the OSC is proportional to the amount of Cerium in the CZO that can readily become reduced from $Ce^{4+}$ to $Ce^{3+}$. In this way, the amount of incorporation of CZO material is correlated with the performance TWC. As the CZO material is deactivated (e.g. oxidized) and degraded for OSC, the performance of the TWC is also degraded. One or more HEGO and/or uHEGO sensors may be positioned upstream and/or downstream of the TWC to measure the TWC OSC due to the change in Cerium oxidation states. As the CZO material degrades, the OSC measured by the HEGO and uHEGO sensors decreases, indicating deactivation and degradation in the TWC performance.

Turning now to FIG. 2, it illustrates a detailed schematic of the emission control device 178 including a plurality of devices 271, 272, and 276. In the example embodiment of FIG. 2, emission control device 178 includes a SCR catalyst 272 positioned in the exhaust passage 148 downstream from a TWC 271. In the depicted embodiment, emission control device 178 may further include additional devices upstream and/or downstream of TWC 271 and/or SCR 272; for example, device 276 may be a diesel oxidation catalyst (DOC), diesel particulate filter (DPF), NOx trap, various other emission control devices, or combinations thereof. Alternative arrangements are also possible in some embodiments, such as only device 271 and device 272 being arranged in the exhaust passage. For the SCR catalyst (e.g., device 272), reductant (e.g., $NH_3$) may be produced via the upstream TWC. However, in some embodiments, a reductant tank 273 may be present to store reductant, such as urea or $NH_3$. The tank 273 may be coupled to an injector 275 to inject reductant into the exhaust upstream of the device 272 or into the device 272 in order to reduce NOx in the device 271. Further, a mixer 274 may be provided to ensure adequate mixing of the reductant within the exhaust stream. Ammonia may be injected in proportion to an amount of engine feed gas NOx entering the SCR.

Exhaust gas sensors 225, 226 and 227 for measuring the exhaust gas composition are shown coupled to exhaust passage 148 and are each communicatively coupled for transmitting signals to controller 12. Exhaust gas sensors 225, 226 and 227 each may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Sensor 225 may be an upstream sensor provided upstream of emission control devices 271, 272, and 276, while sensor 226 be an intermediate sensor provided downstream of emission control device 271 and upstream of emission control device 272. Sensor 227 may be a downstream sensor provided downstream of emission control device 272.

In one example, exhaust gas sensors 225, 226, and 227 may each include oxygen sensors such as a UEGO, EGO, and/or HEGO. In another example, one or more of exhaust gas sensors 225, 226, and 227 may include a NOx sensor. As described further herein, an SCR catalyst 272 may be positioned downstream of the TWC 271 in exhaust passage 148 to capture emissions of $NH_3$ and breakthrough NOx from the TWC 271. The $NH_3$ adsorbed at the SCR can subsequently convert NOx gas to $N_2$ during breakthrough events following TFSO and engine start-stop.

In an SCR catalyst, a metal ion (e.g., ion-exchanged metals such as iron, Fe, and/or copper, Cu, and the like) attaches to aluminum present within a zeolite substrate. For the case of a copper-based SCR catalyst, copper ion is attached to aluminum present in a zeolitic structure. $NH_3$ in the exhaust can be adsorbed at a copper ion. During engine operation, the copper component of the SCR catalyst can undergo a redox reaction, transitioning between two oxidation states, $Cu^{1+}$ (reduced state) and $Cu^{2+}$ (oxidized state), as shown in equation (2).

$$(Cu^{1+},\text{reduced state})Cu_2O + \tfrac{1}{2}O_2 \leftrightarrow 2CuO(Cu^{2+},\text{oxidized state}) \quad (2)$$

The copper ion can transition between the $Cu^{1+}$ and $Cu^{2+}$ oxidation states depending on exposure to reductive versus oxidative gas conditions in the exhaust, respectively. During certain engine operating conditions, including when an exhaust temperature is greater than a threshold exhaust temperature and when an air-to-fuel ratio is richer than a threshold air-to-fuel ratio, the aluminum can be degraded from the zeolitic structure of the SCR catalyst, which frees the metal ion (e.g., copper ion) from the surface, thereby deactivating the SCR catalyst. Deactivation of the SCR catalyst can allow for increased emissions of $NH_3$ and NOx from the engine exhaust. As such, diagnosing the deactivation extent of an SCR catalyst can aid in reducing unwanted exhaust emissions by preventing breakthrough at the SCR catalyst. Although the description herein is for copper-based SCR catalysts, analogous methods and systems can be applied to other metal-based SCR catalysts, such as iron-based SCR catalyst, and the like. For the case of an iron-based (Fe) or other non-copper metal (M) SCR catalyst, the reduced metal state may be $Fe^{2+}$ or $M^{x+}$, respectively, and the oxidized metal state may be $Fe^{3+}$ or $M^{(x+1)+}$, respectively. Irreversible deactivation may occur by way of reduction of $Fe^{2+}$ to Fe, or $M^{x+}$ to M, respectively, above an upper threshold temperature.

Figure 7:
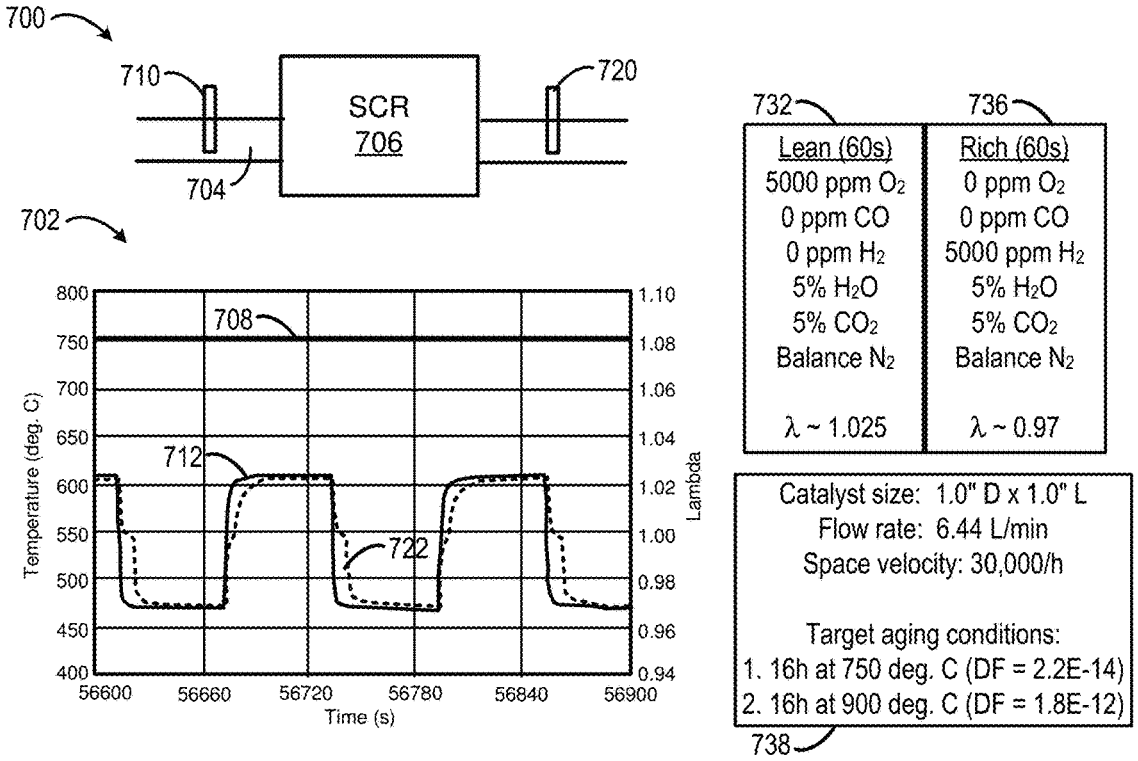
FIG. 7-11 show example schematics and plots illustrating SCR catalyst deactivation and aging characteristics during operation of the engine system of FIG. 1.

Turning now to FIG. 7, it illustrates a flow reactor 700 and conditions for hydrothermally aging a copper-based SCR catalyst to develop a diagnostic method for SCR catalyst deactivation. An SCR catalyst 706 (e.g., cylindrical catalyst core size measuring 1.0" diameter×1.0" long) is positioned within a test exhaust passage 704 of flow reactor 700, along with exhaust gas sensors 710 and 720 positioned upstream and downstream of the SCR catalyst 706, respectively. The flow reactor 700 may be partially enclosed in an oven or other device to regulate the temperature. The SCR catalyst 706 is experimentally aged by cycling every 60s between rich conditions (Table 736) and lean conditions (Table 732) by adjusting a gas composition fed to the flow reactor 700 to provide three differently aged samples of the SCR catalyst: fresh SCR catalyst (non-aged), full useful life SCR catalyst (aged at 750 degrees C. for 16h, and deactivated SCR catalyst (aged at 900 degrees C. for 16h). These three differently-aged SCR catalyst samples may be utilized in testing to probe different approaches for monitoring and diagnosing SCR catalyst deactivation. Other reactor flow and catalyst parameters are listed in Table 738. Using the three differently aged samples, an aging correlation may be developed using various probe tests and the exhaust gas sensors 710 and 720. Measurements transmitted by exhaust gas sensors 710 and 720 are illustrated in plot 702 by traces of $\lambda_{upstream}$ 712 and $\lambda_{downstream}$ 722, respectively, during the rich and lean condition cycling, while a temperature sensor generates a temperature data 708 for the full useful life aged samples. As shown in plot 702, $\lambda_{downstream}$ 722 measured data slightly lags that of $\lambda_{upstream}$ 712.

FIGS. 8-13 illustrate various approaches for correlating exhaust gas composition measurements to SCR catalyst deactivation extent in real-time. In a first approach, SCR catalyst deactivation is probed by monitoring NOx conversion, as given by the standard SCR reaction, shown in equation (3):

$$4NO+4NH_3+O_2 \rightarrow 4N_2+6H_2O \quad (3)$$

As SCR catalyst deactivation extent increases, less $NH_3$ is available for NOx conversion since adsorption of $NH_3$ by the SCR catalyst is reduced, thereby reducing NOx conversion at the SCR catalyst. To monitor NOx conversion, each of the fresh and aged SCR catalysts are installed in the flow reactor 700 and subject to a gas mixture simulating engine operation at $\lambda$=1.05, including 350 ppm $NH_3$, 350 ppm NO, 0 ppm $NO_2$, 1% $O_2$, 0 ppm CO, 0 ppm $H_2$, 5% $H_2O$, 5% $CO_2$, with the balance of the gas mixture being $N_2$ (other catalyst and reactor flow parameters given by Table 738 of FIG. 7). In this first approach, one or more of exhaust gas sensors 710 and 720 may include a NOx sensor for monitoring NOx conversion across the SCR catalyst. In one example, a change in NOx composition across the SCR catalyst 706 may be determined by measurements from NOx sensors positioned upstream and downstream from the SCR catalyst 706, respectively. Knowing the NOx gas composition upstream from the SCR catalyst 706, the NOx conversion could be determined by a single NOx sensor 720 downstream from the SCR catalyst 706.

Figure 8:
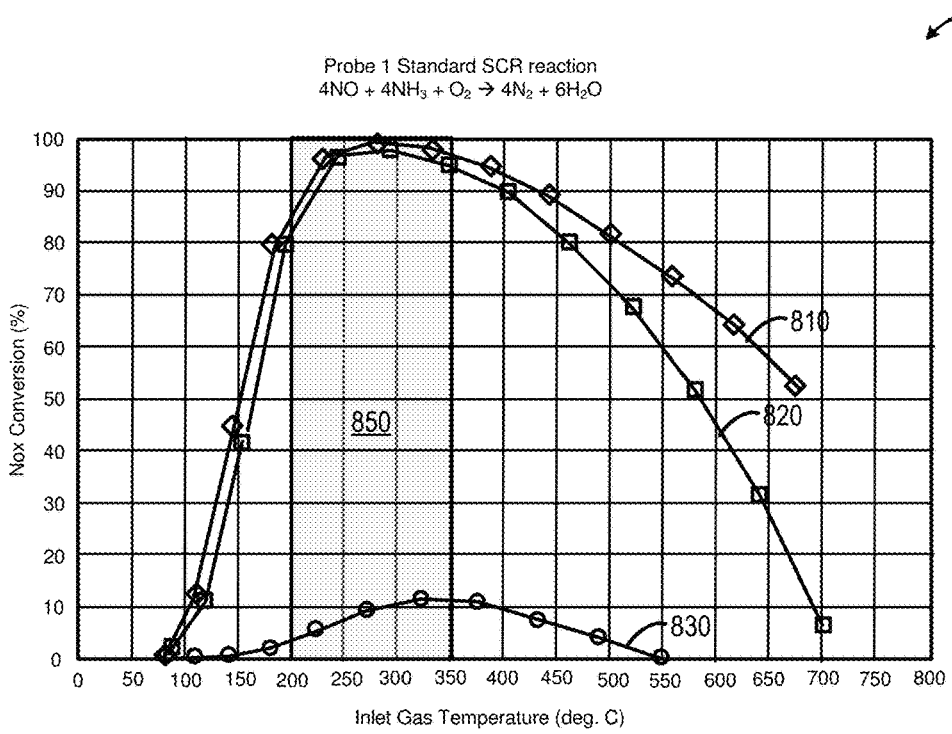

Turning now to FIG. 8, it illustrates a plot 800 of NOx conversion versus inlet gas temperature for fresh 810, full useful life 820, and deactivated 830 SCR catalysts, respectively. The inlet gas mixture temperature is varied from less than 100 degrees Celsius up to 700 degrees Celsius to generate NOx conversion data as a function of temperature for each of the differently-aged SCR catalysts. As shown by the shaded region 850, NOx conversion rates are higher in each of the differently-aged SCR catalysts between 200 and 350 degrees Celsius. The NOx conversion for the full useful life SCR catalyst 820 decreases slightly relative to the fresh SCR catalyst 810 below 350 degrees Celsius; however, the NOx conversion for the deactivated SCR catalyst 830 is significantly lower, decreasing approximately ten-fold (from near 100% to near 10%) upon catalyst deactivation between 200 and 350 degrees Celsius. As such, positioning one or more NOx sensors in an exhaust passage upstream and/or downstream from an SCR catalyst may aid in indicating a deactivated SCR catalyst. However, as shown by plot 800, sensitivity of the NOx sensor in differentiating between fresh and full useful life SCR catalysts may be reduced, especially at temperatures below 350 degrees Celsius. Furthermore, a period of engine operation with increased NOx emissions may be difficult to practically avert once a deactivated SCR catalyst is diagnosed, given the precipitous decline in NOx conversion performance from the full useful life SCR to the deactivated SCR.

In a second approach, SCR catalyst deactivation is probed by monitoring the ammonia oxidation reaction over the SCR catalyst, as given by equations (4-6):

$$4NH_3+3O_2 \rightarrow N_2+3H_2O \quad (4)$$

$$2NH_3+2O_2 \rightarrow N_2O+3H_2O \quad (5)$$

$$4NH_3+5O_2 \rightarrow 4NO+6H_2O \quad (6)$$

Equation (4) represents the desired ammonia oxidation reaction, where $NH_3$ is converted to $N_2$ with no NOx byproducts. As SCR catalyst deactivation extent increases, less $NH_3$ is available for NOx conversion since adsorption of $NH_3$ by the SCR catalyst is reduced, thereby reducing $NH_3$ conversion at the SCR catalyst. To monitor $NH_3$ conversion, each of the fresh and aged SCR catalysts are installed in the flow reactor 700 and subject to a gas mixture simulating engine operation at $\lambda$=1.05, including 350 ppm $NH_3$, 0 ppm NO, 0 ppm $NO_2$, 1% $O_2$, 0 ppm CO, 0 ppm $H_2$, 5% $H_2O$, 5% $CO_2$, with the balance of the gas mixture being $N_2$ (other catalyst and reactor flow parameters given by Table 738 of FIG. 7). In this second approach, one or more of exhaust gas sensors 710 and 720 may include a $NH_3$/NOx sensor for monitoring $NH_3$ conversion and selectivity of $NH_3$ conversion to $N_2$ at the SCR catalyst. In one example, a change in $NH_3$ composition across the SCR catalyst 706 may be determined by measurements from $NH_3$ sensors positioned upstream and downstream from the SCR catalyst 706, respectively. Knowing the $NH_3$ gas composition upstream from the SCR catalyst 706, the $NH_3$ conversion could be determined by a single $NH_3$ sensor 720 downstream from the SCR catalyst 706. Additionally, a change in NOx composition across the SCR catalyst 706 may be determined by one or more NOx sensors positioned downstream and/or upstream from the SCR catalyst 706, which can be used to calculate the selectivity of $NH_3$ oxidation to $N_2$ (equation (4), relative to $NH_3$ oxidation to $N_2O$ and NO (equations 5 and 6, respectively).

Figure 9:
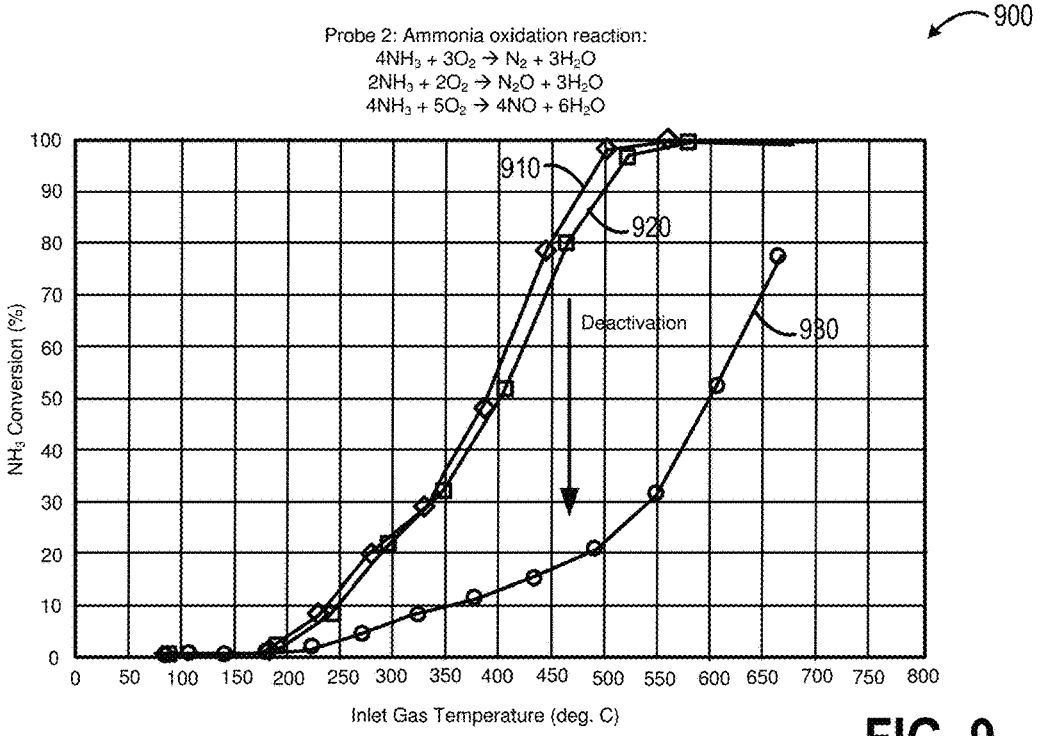
Figure 10:
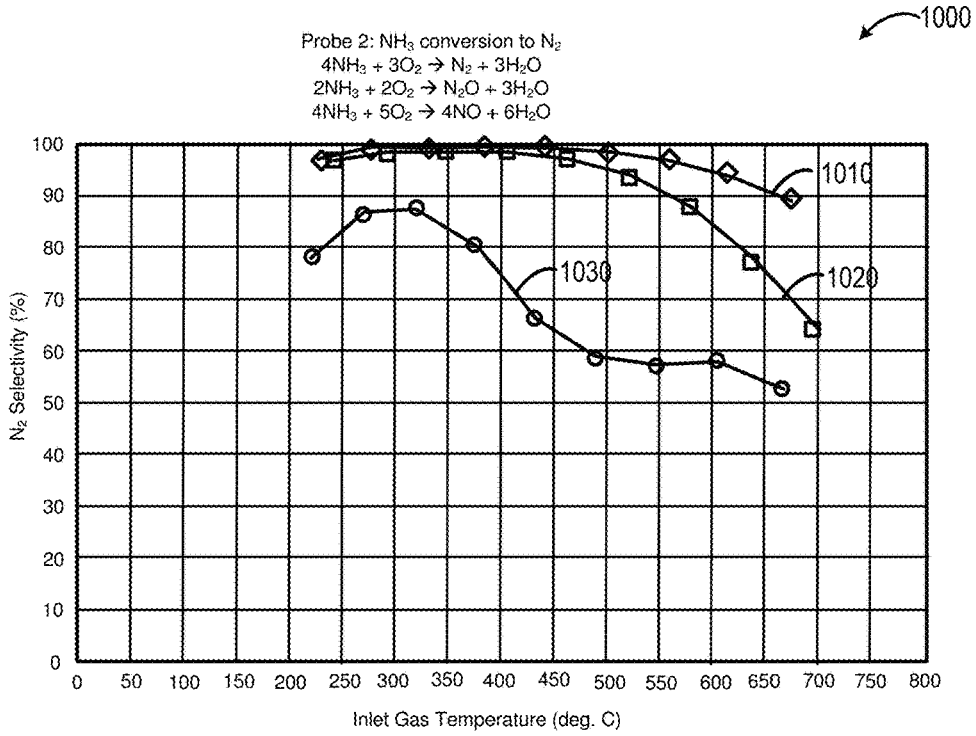

Turning now to FIGS. 9 and 10, they illustrate plots 900 and 1000 of $NH_3$ conversion and $NH_3$ conversion to $N_2$ selectivity versus inlet gas temperature for fresh 910 and 1010, full useful life 920 and 1020, and deactivated 930 and 1030 SCR catalysts, respectively. The inlet gas mixture temperature is varied from less than 100 degrees Celsius up to 700 degrees Celsius to generate reaction data as a function of temperature for each of the differently-aged SCR catalysts. As shown by the plot 900 and 1000, $NH_3$ conversion rates and $N_2$ selectivity are higher in each of the fresh and full useful life SCR catalysts between about 400 and 600 degrees Celsius. In particular, $NH_3$ conversion is close to 100% at 500 degrees Celsius and above, while $N_2$ selectivity is near 100% between 250 and 600 degrees Celsius. The $NH_3$ conversion and $N_2$ selectivity for the full useful life SCR catalyst 920 and 1020 decreases slightly relative to the fresh SCR catalyst 910 and 920 over certain temperature ranges; however, the $NH_3$ conversion and $N_2$ selectivity for the deactivated SCR catalyst 930 and 1030 is significantly lower. As such, positioning one or more $NH_3$/NOx sensors in an exhaust passage upstream and/or downstream from an SCR catalyst may aid in indicating a deactivated SCR catalyst. However, as shown by plots 900 and 1000, sensitivity of the $NH_3$/NOx sensor in differentiating between fresh and full useful life SCR catalysts may be reduced, especially at temperatures below 500 degrees Celsius. Furthermore, a period of engine operation with increased $NH_3$ and NOx emissions may be difficult to practically avert once a deactivated SCR catalyst is diagnosed, given the precipitous decline in $NH_3$ conversion performance and $N_2$ selectivity from the full useful life SCR to the deactivated SCR.

In a third approach, SCR catalyst deactivation is probed by determining a $NH_3$ storage capacity of the SCR catalyst. The $NH_3$ storage capacity is proportional to the amount of active aluminum ions present in the zeolite structure of the SCR catalyst. As described herein, the aluminum ions are inactivated for $NH_3$ adsorption under hydrothermal conditions above a lower threshold exhaust temperature. As SCR catalyst deactivation extent increases (from fresh to full useful life to deactivated states), less $NH_3$ is available for NOx conversion since adsorption of $NH_3$ by the SCR catalyst is reduced, thereby reducing NOx conversion at the SCR catalyst. To monitor $NH_3$ storage capacity, each of the fresh and aged SCR catalysts are installed in the flow reactor 700 and subject to a gas mixture simulating engine operation at $\lambda$=1.00, including 350 ppm $NH_3$, 0 ppm NO, 0 ppm $NO_2$, 0% $O_2$, 0 ppm CO, 0 ppm $H_2$, 5% $H_2O$, 5% $CO_2$, with the balance of the gas mixture being $N_2$ (other catalyst and reactor flow parameters given by Table 738 of FIG. 7). In this third approach, $NH_3$ storage capacity may be measured by an exhaust gas sensor 720 positioned downstream of the SCR catalyst 706. In one example, the exhaust gas sensor 720 may include an $NH_3$ sensor. In another example, the exhaust gas sensor 720 may include an oxygen gas sensor (e.g., a uHEGO or HEGO), wherein the quantity of adsorbed $NH_3$ released from the SCR catalyst 706 can be detected by the oxygen gas sensor in the same manner as it senses $H_2$ gas.

Exposing the SCR catalyst 706 to a temperature greater than a lower threshold exhaust temperature releases the $NH_3$ adsorbed thereat, and whose quantity can be measured by the exhaust gas sensor 720. In one example, the lower threshold exhaust temperature includes 600 degrees Celsius. In another example, the preferred lower threshold exhaust temperature includes 500 degrees Celsius. In another example, the more preferred lower threshold exhaust temperature includes 400 degrees Celsius. In another example, the most preferred lower threshold exhaust temperature includes between 400 and 500 degrees Celsius. In a further example, the SCR catalyst temperature is increased in a temperature ramp from an engine operating temperature (e.g., 200-400 degrees Celsius) rapidly above a threshold temperature ramp rate to increase a rate of $NH_3$ release from the SCR catalyst. Increasing a rate of $NH_3$ release from the SCR catalyst may be advantageous since it aids in increasing an exhaust gas composition sensor measurement sensitivity and accuracy. In one example, the threshold temperature ramp rate includes a positive non-zero rate of temperature increase.

As one example of the third approach, the SCR catalyst temperature is ramped up to the lower threshold exhaust temperature (e.g., 600 degrees C.) to remove stored $NH_3$ from the SCR catalyst. Subsequently, the SCR catalyst, substantially free from $NH_3$, is stabilized at the evaluation temperature. The flow reactor gas mixture is pulsed over the SCR catalyst at the evaluation temperature until the SCR catalyst becomes saturated with $NH_3$. Using the exhaust gas sensor measurements, the amount of $NH_3$ stored at the SCR catalyst is calculated. Repetition of these steps at each evaluation temperature allows determining the SCR catalyst $NH_3$ storage capacity with temperature.

Figure 11:
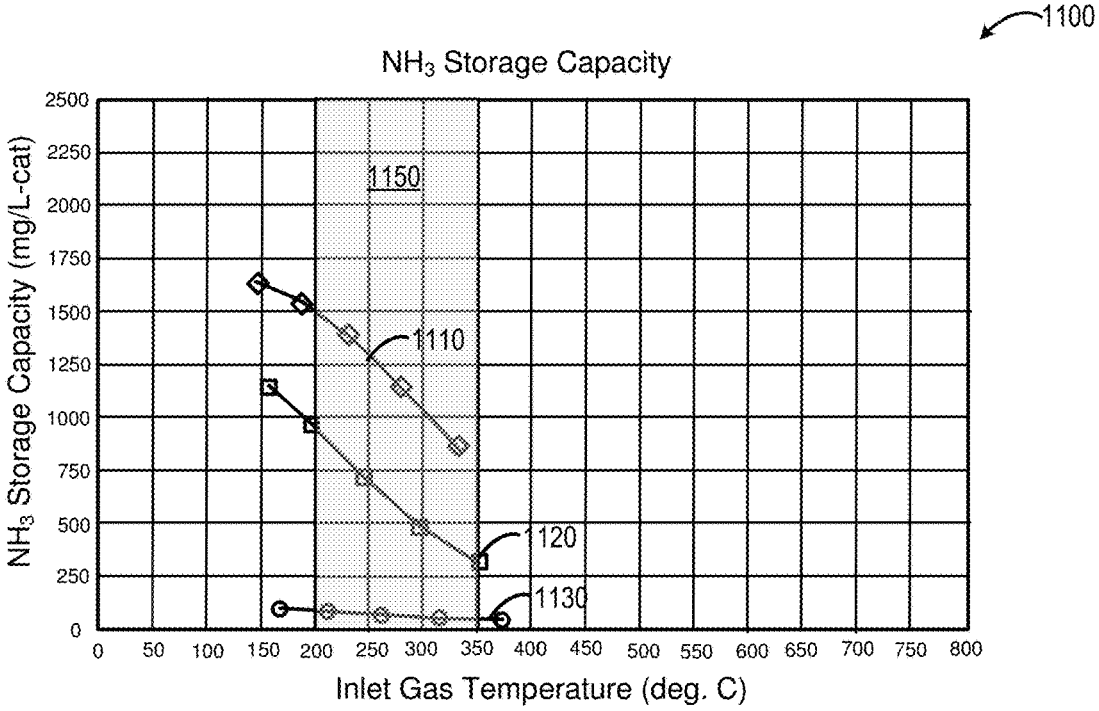

Turning now to FIG. 11, it illustrates a plot 1100 of $NH_3$ storage capacity versus inlet gas temperature for fresh 1110, full useful life 1120, and deactivated 1130 SCR catalysts, respectively. The inlet gas mixture temperature is varied from less than 100 degrees Celsius up to less than 400 degrees Celsius to generate $NH_3$ storage capacity data as a function of temperature for each of the differently-aged SCR catalysts. As shown by the shaded region 1150, $NH_3$ storage capacity is higher in each of the differently-aged SCR catalysts between 200 and 350 degrees Celsius, and favorable during engine operation to aid in ensuring that there is a sufficient amount of $NH_3$ stored (e.g., adsorbed) at the SCR catalyst for converting NOx gas during NOx breakthrough events. As shown by comparing data for the fresh 1110 and full useful life 1120 SCR catalysts, the $NH_3$ storage capacity of the full useful life 1120 SCR catalyst is significantly lower (e.g., deactivated) as compared to the fresh SCR catalyst, having a $NH_3$ storage capacity of about 500 mg/L-cat less over all inlet gas temperatures. In contrast, the $NH_3$ storage capacity of the deactivated 1130 SCR catalyst is relatively small (e.g., <~100 mg/L-cat) over the inlet gas temperatures. As such, positioning a $NH_3$ or oxygen gas sensor downstream from an SCR catalyst may aid in indicating a deactivated SCR catalyst. In particular, as shown by plot 1100, the $NH_3$ or oxygen gas sensor may allow for differentiating between fresh and full useful life SCR catalysts, as well as between full useful life and deactivated SCR catalysts, especially at gas temperatures between 150 and 350 degrees Celsius. As such, diagnosing SCR catalyst deactivation by monitoring $NH_3$ storage capacity may aid in reducing $NH_3$ and NOx emissions since $NH_3$ storage capacity may steadily decline over the useful life of a SCR catalyst and beyond when the SCR catalyst becomes deactivated.

In a fourth approach, SCR catalyst deactivation is probed by determining an oxygen storage capacity (OSC) of the SCR catalyst. As previously described with reference to equation (1), the TWC exhibits an oxygen storage capacity that decreases as the Cerium ions in the catalyst are oxidized from $Ce^{3+}$ to $Ce^{4+}$ as the TWC ages. Turning to FIG. 12, it illustrates a plot 1200 of oxygen storage capacity (shown as micro-moles of oxygen per catalyst core) versus inlet gas temperature for fresh 1210, full useful life 1220, and deactivated 1230 TWC catalysts, respectively. The TWC is aged similarly to the SCR probe experiments as described with reference to FIG. 7, by cycling between redox lean and rich aging conditions. During aging, the full useful life 1220 TWC is subject to 1110 degrees Celsius for 6 hours and the deactivated 1230 TWC is subject to 1030 degrees Celsius for 150 hours. After aging, the inlet gas mixture temperature is varied from less than 100 degrees Celsius up to 700 degrees Celsius to generate oxygen storage capacity data as a function of temperature for each of the differently-aged TWC catalysts. As evidenced by plot 1200, the oxygen storage capacity for the full useful life TWC catalyst 1220 decreases relative to the fresh TWC catalyst 1210; furthermore, the oxygen storage capacity for the deactivated TWC catalyst 1230 is significantly lower. Thus, the oxygen storage capacity of a TWC decreases with aging and extent of deactivation of the TWC.

In contrast to the OSC characterization for the case of a TWC, as described above with reference to equation (2), the SCR catalyst contains a predetermined amount of copper adsorbed to aluminum sites present in the zeolitic structure of the SCR catalyst, wherein the copper undergoes reversible redox transitions between a reduced state ($Cu^{1+}$) and an oxidized state ($Cu^{2+}$), depending on exposure to rich or lean conditions. The OSC of the SCR catalyst is proportional to the amount of active aluminum ions present in the zeolite structure of the SCR catalyst. As described herein, the aluminum ions are degraded under severe hydrothermal conditions above an upper threshold exhaust temperature.

When the aluminum ions are degraded at temperatures reaching the upper threshold exhaust temperature, the adsorbed copper ions are freed and expelled from the zeolite structure of the SCR catalyst. Degradation of the aluminum ions can lead to sintering of the copper into larger particles, thus making the copper unavailable to return to the ion-exchanged copper state in the zeolite structure of the SCR catalyst. The free copper ion is thus made available for an irreversible further reduction reaction to copper metal, according to equation (7):

$$2CuO \leftrightarrow Cu_2O + \tfrac{1}{2}O_2 \rightarrow 2Cu^0 \text{ metal} + O_2 \quad (7)$$

As per equation (7), $Cu^{2+}$ represents an oxidized state, $Cu^{1+}$ represents a reduced state, and $Cu^0$ represents a further reduced state. Furthermore, as the copper ion is reduced (from left to right in equation (7)), the amount of gaseous oxygen produced increases. As described above further reduction of the copper ion to copper metal indicates deactivation of the SCR catalyst. In the oxidized state ($Cu^{2+}$), one oxygen atom is adsorbed for every copper ion, whereas in the reduced state ($Cu^{1+}$), one oxygen atom is adsorbed for every two copper ions. When copper ion is further reduced to copper metal, no oxygen is adsorbed. As such, as SCR catalyst deactivation extent increases, less copper is available for oxygen storage since aluminum sites are degraded, facilitating further reduction of copper ion to copper metal.

In one example, the upper threshold exhaust temperature includes 900 degrees Celsius. In one example, exposure of the SCR catalyst to the upper threshold exhaust temperature beyond a threshold deactivation duration may result in a fully deactivated SCR catalyst whereby the SCR deactivation extent is such that substantially all the copper ion is irreversibly reduced to copper metal. Furthermore, the upper threshold exhaust temperature and the threshold deactivation duration may exhibit an Arrhenius relationship, whereby the threshold deactivation duration corresponding to a lower upper threshold exhaust temperature may be longer. For example, the SCR catalyst may become fully deactivated upon exposure to an upper threshold temperature of 900 degrees Celsius for a threshold deactivation duration of 16 h; furthermore, the SCR catalyst may become fully deactivated upon exposure to an upper threshold temperature of 850 degrees Celsius for a threshold deactivation duration of 60 h; furthermore, the SCR catalyst may become fully deactivated upon exposure to an upper threshold temperature of 1000 degrees Celsius for a threshold deactivation duration of 1.6 h.

To monitor oxygen storage capacity of the SCR catalyst, each of the fresh and aged SCR catalysts are installed in the flow reactor 700 and subject to a gas mixture simulating engine operation, as described above with reference to FIG. 7. The SCR catalyst 706 is experimentally aged by cycling every 60 s between rich conditions (Table 736) and lean conditions (Table 732) by adjusting a gas composition fed to the flow reactor 700 to provide three differently aged samples of the SCR catalyst: fresh SCR catalyst (non-aged), full useful life SCR catalyst (aged at 750 degrees C. for 16 h, and deactivated SCR catalyst (aged at 900 degrees C. for 16 h). Other catalyst and reactor flow parameters are given by Table 738 of FIG. 7.

In this fourth approach, oxygen storage capacity may be measured by positioning an exhaust gas sensor 720 downstream of the SCR catalyst 706, and measuring the differences in the exhaust gas sensor signals 712 and 722, corresponding to the oxygen gas composition at lean and rich conditions, respectively. At exhaust temperatures below the upper threshold exhaust temperature, the copper ion in the SCR catalyst transitions between the oxidized ($Cu^{2+}$) and reduced ($Cu^{1+}$) states. According to equation (7), reduction of the $Cu^{2+}$ to $Cu^{1+}$ releases and increases the amount of oxygen (e.g., 1 oxygen atom per copper ion) in the exhaust downstream of the SCR catalyst, whereas oxidation of the $Cu^{1+}$ to $Cu^{2+}$ in the SCR catalyst consumes oxygen and oxygen in the exhaust downstream of the SCR catalyst may decrease. By measuring these changes to the oxygen composition downstream of the SCR catalyst, the exhaust gas sensor 720 can indicate reversible changes in the oxygen storage capacity of the SCR catalyst. In contrast, at exhaust temperatures above the upper threshold exhaust temperature, the copper ion in the SCR catalyst is irreversibly reduced to copper metal and any oxygen previously adsorbed thereat is released into the exhaust downstream of the SCR catalyst. Thus, by measuring changes to the oxygen composition downstream of the SCR catalyst, the exhaust gas sensor 720 can further indicate irreversible changes in the oxygen storage capacity of the SCR catalyst brought about by irreversible deactivation of the SCR catalyst. In one example embodiment, the exhaust gas sensor 720 may include an oxygen gas sensor such as a HEGO or uHEGO. In another example, the oxygen gas composition may be measured by the exhaust gas sensor 720, including a NOx sensor. Utilizing a HEGO or uHEGO as the exhaust gas sensor 720 may be advantageous as compared to a NOx sensor since a HEGO or uHEGO sensor is less costly than a NOx sensor.

Turning now to FIG. 13, it illustrates a plot 1300 of oxygen storage capacity, indicated as micro-moles of O per catalyst core, versus inlet gas temperature for fresh 1310, full useful life 1320, and deactivated 1330 SCR catalysts, respectively. The inlet gas mixture temperature is varied from less than 100 degrees Celsius up to about 750 degrees Celsius to generate oxygen storage capacity data as a function of temperature for each of the differently-aged SCR catalysts. As described above, the oxygen storage capacity can be indicated by the amount of oxygen measured downstream of the SCR catalyst. Referring to plot 1300, the oxygen storage capacity increases with increasing SCR catalyst aging in each of the differently-aged SCR catalysts between 300 and 600 degrees Celsius. In the methods and systems described herein, measurement of the SCR catalyst OSC between 400 and 600 degrees Celsius may be preferable because the copper ion more strongly interacts with the zeolite in these temperature range. Below 400 degrees Celsius, binding of the copper ion at the zeolite can be less predictable; above 600 degrees Celsius, the copper OSC mechanism can change. Thus, between 400 and 600 degrees Celsius, measurement of the change in oxidation states from $Cu^{2+}$ to $Cu^{1+}$ and characterization of the SCR catalyst OSC may be more reliable and accurate. Additionally, below the upper threshold exhaust temperature, reduction and oxidation of the copper ion in the SCR catalyst is reversible, and the oxygen storage capacity varies within a predictable range of values. In contrast, above the upper threshold exhaust temperature, the copper can be irreversibly reduced to copper metal thereby deactivating the SCR catalyst. When substantially all of the copper ion is reduced to copper metal, the SCR catalyst becomes fully deactivated.

As shown by comparing data for the fresh 1310 and full useful life 1320 SCR catalysts, the oxygen storage capacity of the full useful life 1320 SCR catalyst tends to be higher (e.g., more deactivated) relative to the fresh 1310 SCR catalyst, especially at temperatures above 400 degrees Celsius. Furthermore, the oxygen storage capacity of the deactivated 1330 SCR catalyst is significantly higher than the fresh 1310 and full useful life 1320 SCR catalysts (e.g., <~100 mg/L-cat) over the inlet gas temperatures between 400 and 600 degrees Celsius. In the example of plot 1300, the oxygen storage capacity of the deactivated 1330 SCR catalyst is about double the oxygen storage capacity of the full useful life 1320 SCR. Thus, as the SCR catalyst ages and as the SCR catalyst deactivation extent increases, the oxygen content in the exhaust downstream from the SCR catalyst increases.

As such, positioning an exhaust gas sensor downstream from an SCR catalyst to measure oxygen gas content may aid in indicating a deactivated SCR catalyst. In particular, as shown by plot 1300, the oxygen gas sensor may allow for differentiating between reversible changes to oxygen storage capacity (e.g. when exhaust temperatures are less than the upper threshold exhaust temperature), and irreversible changes to oxygen storage capacity (e.g., following exposure of the SCR catalyst to temperatures above the upper threshold exhaust temperature). Furthermore, an increase in oxygen storage capacity may correspond to an increase in deactivation extent at the SCR catalyst while a decrease in oxygen storage capacity may correspond to a decrease in deactivation extent at the SCR catalyst. Further still, measurement of the oxygen content downstream of the SCR may allow for differentiating between a fresh and full useful life SCR catalysts, as well as between full useful life and deactivated SCR catalysts, especially at gas temperatures above 400 degrees Celsius. As such, diagnosing SCR catalyst deactivation by monitoring oxygen storage capacity may aid in reducing $NH_3$ and NOx emissions since oxygen storage capacity may steadily decline over the useful life of a SCR catalyst and beyond when the SCR catalyst becomes deactivated.

In this way, an oxygen storage capacity of the SCR catalyst may be correlated to the exhaust oxygen composition downstream from the SCR catalyst. In contrast, measurement of an exhaust gas composition above a first threshold oxygen concentration may indicate substantial irreversible deactivation of the SCR catalyst, whereby the ionic copper in the SCR catalyst has predominantly been freed from degraded aluminum sites and subsequently reduced to copper metal. In one example, the first threshold oxygen concentration may include 450 micromoles of oxygen per catalyst core. In other words, a measured exhaust gas oxygen concentration is greater than the first threshold oxygen concentration may indicate a deactivated SCR catalyst (e.g., deactivated SCR catalyst 1330). Furthermore, measurement of an exhaust gas composition below a second threshold oxygen concentration may indicate a fresher SCR catalyst, with perhaps only a smaller amount of reversible deactivation. In one example, the second threshold oxygen concentration may include 225 micromoles of oxygen per catalyst core, corresponding to a full useful life SCR catalyst, 1320. In other words, a measured exhaust gas oxygen concentration below the third threshold oxygen concentration may indicate a fresher SCR catalyst (e.g., fresh SCR catalyst 1310), having no substantial reversible or irreversible deactivation, where some or all the copper ion in the SCR catalyst is in an oxidized (e.g., $Cu^{2+}$) state. Further still, measurement of an exhaust gas composition below the first threshold oxygen concentration and above the second threshold exhaust gas oxygen concentration (e.g., between 225 and 450 micromoles of oxygen per catalyst core) may indicate a partially deactivated SCR catalyst. Responsive to SCR catalyst OSC measurements between 225 and 450 micromoles of oxygen per catalyst core, regeneration of the SCR catalyst may be initiated. Regeneration of the SCR catalyst may include operating the engine in a leaner air-to-fuel ratio exhaust condition. Following regeneration of the SCR catalyst, remeasurement of the SCR catalyst OSC between the first and second threshold oxygen concentrations (e.g., between 225 and 450 micromoles of oxygen per catalyst core) may indicate the presence of irreversible deactivation of the SCR catalyst. In contrast, remeasurement of the SCR catalyst OSC following regeneration below the second threshold oxygen concentration (e.g., below 225 micromoles of oxygen per catalyst core) may indicate successful regeneration of the SCR catalyst where the reduction of the copper ions has been reversed. In this way, reversible deactivation and irreversible deactivation at the SCR catalyst may be differentiated and determined.

Measurements from one or more exhaust gas sensors 225, 226, and 227 may be utilized to determine an extent of deactivation of the SCR catalyst 272 during engine operation. Specifically, during certain engine operating conditions, measurement of the exhaust gas composition by one or more of exhaust gas sensors 225, 226, and 227 may be used to calculate an oxygen storage capacity of the SCR catalyst 272. Subsequently, the extent of deactivation can be determined from the oxygen storage capacity of the SCR catalyst 272. Furthermore, engine operation can be adjusted based on the extent of deactivation of the SCR catalyst 272 to mitigate exhaust emissions. In the case of a fully deactivated SCR catalyst, because the $NH_3$ storage capability at the SCR catalyst is reduced, engine operation is adjusted to reduce active $NH_3$ formation at the TWC. In other words, the engine rich operation is decreased. In addition, the number of engine fuel shutoff events may be reduced or eliminated. Further still, the controller 12 may notify a vehicle operator when an SCR deactivation extent increases beyond an upper threshold deactivation extent; for example, the vehicle operator may receive an indication by way of the instrument panel 196 that the vehicle needs service. In another example, the controller 12 may display a historical data plot or a numerical indicator of the remaining % useful life of an ECD 178 or an SCR catalyst 272 to the vehicle operator at instrument panel 196. In this manner, engine emissions, particularly emissions of NOx and NH3, may be reduced, while maintaining a cost of manufacture and operation of the engine and vehicle system.

Turning now to FIGS. 3-5, they illustrate flow charts for methods 300, 400, and 500, of operating a vehicle 5. Instructions for carrying out method 300 and the rest of the methods included herein may be executed by a controller 12 based on instructions stored on a memory of the controller 12 and in conjunction with signals received from sensors of the engine system 10, such as the sensors described above with reference to FIGS. 1 and 2. The controller 12 may employ engine actuators of the engine system 10 to adjust engine operation, according to the methods described below. Method 300 begins at 310 where the controller 12 estimates and/or measures various engine operating conditions such as the engine status, exhaust temperature, engine and/or exhaust air-to-fuel ratio (e.g., λ, the ratio of the air-to-fuel ratio to the stoichiometric air-to-fuel ratio), exhaust gas composition, and the like. Next, method 300 continues at 320 where the controller 12 determines if an SCR evaluation condition has been met. As shown by the example flow chart for the method 400 at 410 in FIG. 4, the SCR evaluation condition may be met by one or more of $\lambda<\lambda_{TH}$, the exhaust temperature ($T_{exhaust}$) being greater than a threshold exhaust temperature ($T_{exhaust,TH}$), and an elapsed time (Δt) since the SCR evaluation condition was last determined being greater than a threshold duration ($\Delta t_{TH}$). $\lambda_{TH}$ may include a non-zero positive threshold value of λ below which the air-to-fuel ratio is rich enough to facilitate reduction of the copper ion in the SCR catalyst to a less positive oxidation state. In one example, $\lambda_{TH}$ may correspond to a value of 1. In another example, $\lambda_{TH}$ may correspond to a value of 0.97. $T_{exhaust,TH}$ may correspond to a non-zero positive temperature above which a likelihood of aluminum in the SCR catalyst may be degraded may increase, thereby freeing copper ions, which can then be reduced to copper metal. In one example, $T_{exhaust,TH}$ may include temperatures greater than 900 degrees Celsius. $\Delta t_{TH}$ may refer to a non-zero positive elapsed time beyond which a likelihood of increased emissions breaking through the SCR may be raised. In one example, $\Delta t_{TH}$ may decrease as the SCR deactivation extent increases and/or approaches an threshold SCR deactivation extent (see step 360 of method 300). In other words, as the SCR deactivation extent increases towards the threshold SCR deactivation extent, the frequency of measuring the exhaust gas composition and determining the OSC of the SCR catalyst may increase to reduce a likelihood of break through emissions due to a deactivated SCR catalyst. If the SCR evaluation condition is met, then method 400 continues to 420 before returning to method 300; if the SCR evaluation condition is not met, then method 400 continues to 414 before returning to method 300.

For the case where the SCR evaluation condition is met at 410, method 300 continues at 330 where the controller measures the exhaust gas composition. Measuring the exhaust gas composition may include one or more of measuring the exhaust gas composition downstream and/or upstream from the SCR catalyst. In one example, measuring the exhaust gas composition includes measuring the exhaust gas oxygen composition downstream from the SCR catalyst with an exhaust gas composition sensor such as an HEGO sensor, uHEGO sensor, or NOx sensor. Next, based on the measured exhaust gas composition, an oxygen storage capacity of the SCR catalyst is determined. A correlation of the exhaust gas oxygen to OSC may be utilized to determine the OSC of the SCR catalyst. For example, as described with reference to FIG. 13, experimental data can be used to correlate measured exhaust gas oxygen with OSC of the SCR catalyst. Method 300 continues at 350 where an SCR deactivation extent may be indicated based on the calculated OSC.

The SCR deactivation extent may be determined according to the method 500 of FIG. 5. Method 500 begins at 510 where the controller 12 may evaluate if the SCR is a fresh SCR catalyst by determining if the OSC of the SCR catalyst is less than a lower threshold OSC, $OSC_{TH}$. In one example, the lower threshold OSC may correspond to the third threshold OSC, as referred to in FIG. 13. For the case where OSC is not less than $OSC_{TH}$, method 500 continues at 520 where the controller 12 evaluates if the SCR is a fully deactivated catalyst by determining if the OSC of the SCR catalyst is greater than a higher threshold OSC, $OSC_{TH,HIGH}$. In one example, the higher threshold OSC may correspond to the first threshold OSC, as referred to in FIG. 13.

For the case where OSC is not greater than $OSC_{TH,high}$, method 500 continues at 526 where the controller 12 indicates a partially deactivated SCR catalyst. A partially deactivated SCR catalyst may refer to an SCR catalyst deactivation extent between a fresh SCR catalyst and a fully deactivated SCR catalyst. In other words a portion of the copper ion at the SCR catalyst has been reduced (reversibly or irreversibly) to $Cu^{1+}$; in addition, a portion of the copper ion may have been irreversibly reduced to copper metal. Method 500 continues at 530 where the change in OSC, ΔOSC, relative to the previous OSC measurement is greater than 0. For the case where ΔOSC is not greater than 0, method 500 continues to 534 where a decrease in SCR deactivation extent is indicated. For the case where ΔOSC is greater than 0, method 500 continues to 540 where an increase in SCR deactivation extent is indicated. An increase in the SCR deactivation extent may include a reversible and/or an irreversible increase in the OSC of the SCR catalyst due to reversible and/or irreversible reduction of copper ion thereat. Indicating an increase in the SCR deactivation extent may include the controller 12 displaying a historical data plot or a numerical indicator of the remaining % useful life (e.g. 100−% SCR deactivation extent) of the SCR catalyst 272 to the vehicle operator at instrument panel 196. In another example, responsive to an increase in a deactivation extent (e.g., increasing beyond a lower threshold deactivation extent corresponding to increasing beyond a second threshold oxygen storage capacity) the controller 12 may display a recommend a more favorable driving pattern or route to the vehicle operator to reduce emissions at the SCR catalyst. In one instance, a more favorable driving pattern may include directing the vehicle travel route to more highway driving and less city driving to decrease TFSO events and to allow for increased opportunity for reactivation or regeneration of the SCR catalyst.

Method 500 continues at 550 where the controller 12 determines if the exhaust temperature, $T_{exhaust}$, is greater than a threshold exhaust temperature, $T_{exhaust,TH}$. $T_{exhaust,TH}$ may refer to a threshold exhaust temperature above which aluminum in the SCR catalyst may be degraded thereby freeing copper ion, and where the freed copper ion may be irreversibly reduced to copper metal. In one example $T_{exhaust,TH}$ may include 900 degrees Celsius; when the SCR catalyst temperature exceeds 900 degrees Celsius, irreversible deactivation of the SCR catalyst occurs, irreversibly increasing an SCR catalyst deactivation extent. For the case where $T_{exhaust}$ is not greater than $T_{exhaust,TH}$, method 500 continues at 554 where the controller 12 indicates a reversible change in the SCR deactivation extent. Indicating the reversible change in the SCR deactivation extent may include updating a historical data plot or numerical representation of the % useful life of the SCR catalyst at an operator instrument panel 196. After 554, method 50 returns to method 300 at 360.

For the case where $T_{exhaust}$ is greater than $T_{exhaust,TH}$, method 500 continues at 560 where the controller 12 indicates an irreversible change in the SCR catalyst deactivation extent. Indicating the irreversible change in the SCR deactivation extent may include updating a historical data plot or numerical representation of the % useful life of the SCR catalyst at an operator instrument panel 196. In one example, the controller 12 may differentiate reversible and irreversible changes to the SCR catalyst deactivation extent at the instrument panel 196 by tracking separate trend lines, as shown in timeline 600 at 660 and 666. Method 500 continues at 570 and 580 where the SCR catalyst OSC baseline and SCR deactivation extent baseline are updated to reflect the irreversible change in SCR catalyst deactivation extent. In one example, the OSC and SCR deactivation extent may be monitored and recorded by the controller 12 in non-transitory memory. The SCR deactivation extent may be available to a vehicle operator and/or service technician as a historical data plot (analogous to the trend line 660 in FIG. 6) showing historical and current data, or as a displayed numerical representation indicating the current % life (100−% SCR deactivation extent) of the SCR catalyst remaining. For example, if the SCR catalyst deactivation extent is 70% deactivated, then the % life remaining would be 30%. For the case where $OSC>OSC_{TH,high}$, method 500 continues at 590 where the controller 12 indicates a fully deactivated SCR catalyst. In one example, an SCR catalyst with an $OSC>OSC_{TH,high}$ may correspond to an SCR catalyst with a deactivation extent being greater than a threshold deactivation extent. Returning to 510 for the case where the $OSC<OSC_{TH}$, method 500 continues at 516, where it indicates a fresh SCR catalyst. After, 510, 516, 580, and 590, method 500 returns to method 300 at 360.

Returning to method 300 at 360, the controller 12 determines if the SCR deactivation extent is greater than a higher threshold SCR deactivation extent. The higher threshold SCR deactivation extent may include when the SCR is fully deactivated. In another case, the higher threshold SCR deactivation extent may include when the SCR deactivation extent is close to fully deactivated. In the case where the SCR deactivation extent is greater than the higher threshold SCR deactivation extent, the controller 12 may continue at 362 where engine operating instructions may be adjusted to mitigate engine emissions. As one example, the controller 12 may adjust engine operating events to reduce TFSO events. Reducing TFSO events may increase fuel consumption, but can aid in lowering a likelihood of NOx and $NH_3$ breakthrough events since the SCR catalyst deactivation extent is greater than the threshold SCR deactivation extent. Furthermore, the controller 12 may notify the operator to service the exhaust system. In one example, the controller 12 may send an audio and/or visual notification to the vehicle operator, for example, by way of the instrument panel 196. After 362, method 300 ends.

Returning to 360, for the case where the SCR deactivation extent is not greater than the higher threshold SCR deactivation extent, method 300 continues at 364 where the controller 12 determines if the SCR deactivation extent is greater than a lower threshold SCR deactivation extent. The lower threshold SCR deactivation extent may include when the SCR is partially deactivated; in one case, the SCR deactivation extent increasing beyond the lower threshold SCR deactivation extent may correspond to when the SCR catalyst OSC increases beyond a second threshold SCR catalyst OSC. In the case where the SCR deactivation extent is greater than the lower threshold SCR deactivation extent, the controller 12 may continue at 366 where engine operation may be adjusted to mitigate engine emissions. As one example, the controller 12 may adjust engine operating conditions to increase opportunities for regeneration of the SCR catalyst. In one example, the controller 12 may recommend the operator to reroute the vehicle to increase highway driving and reduce city driving to reduce TFSO events. In another example, controller 12 may adjust engine operating conditions to operate the engine under leaner air-to-fuel ratios to expose the SCR catalyst to a leaner exhaust environment, thereby encouraging oxidation of copper ion thereat and regeneration of the SCR catalyst. Furthermore, at 366, the controller 12 may notify the operator to communicate these recommendations and vehicle operation adjustments. In one example, the controller 12 may send an audio and/or visual notification to the vehicle operator, for example, by way of the instrument panel 196. After 366, method 300 ends.

As illustrated by examples herein, the method and systems of operating an engine system, including, responsive to an SCR evaluation condition being met, measuring an exhaust gas composition, calculating an SCR OSC based on the measured exhaust composition, indicating an SCR deactivation extent based on the calculated OSC, and adjusting engine operating conditions to mitigate engine emissions responsive to an SCR deactivation extent being greater than an upper threshold SCR deactivation extent, may further include operating a vehicle in a moving and/or idle state while the engine is in a combusting and/or idle status, determining if the SCR evaluation condition is met, and performing actions in response thereto, as well as operating without that condition present, determining that the condition is not present, and performing a different actions in response thereto.

Thus, a method of operating an engine includes positioning an oxygen sensor in an engine exhaust downstream from a selective catalytic reduction (SCR) catalyst, determining an oxygen storage capacity of the SCR catalyst based on a measurement of the oxygen sensor, and determining an extent of deactivation of the SCR catalyst based on the oxygen storage capacity. A first example of the method further includes indicating an increase in the extent of deactivation of the SCR catalyst based on an increase in the oxygen storage capacity. A second example of the method optionally includes the first example and further includes wherein determining the oxygen storage capacity of the SCR catalyst is further based on a measurement of an oxygen sensor positioned upstream of the SCR catalyst. A third example of the method optionally includes one or more of the first and second examples, and further includes indicating a decrease in the extent of deactivation of the SCR catalyst based on a decrease in the oxygen storage capacity. A fourth example of the method optionally includes one or more of the first through third examples, and further includes, wherein the oxygen storage capacity of the SCR catalyst is determined from the measurement with the oxygen sensor in response to a first condition being met, the first condition including when an exhaust gas temperature is greater than a threshold exhaust temperature. A fifth example of the method optionally includes one or more of the first through fourth examples, and further includes, wherein the oxygen storage capacity of the SCR catalyst is determined from the measurement with the oxygen sensor in response to a first condition being met, the first condition including when an air-fuel ratio is below a threshold air-fuel ratio (rich). A sixth example of the method optionally includes one or more of the first through fifth examples, and further includes, indicating a degraded SCR catalyst in response to an increase in the determined oxygen storage capacity of the SCR catalyst beyond a threshold oxygen storage capacity. A seventh example of the method optionally includes one or more of the first through sixth examples, and further includes, wherein the threshold oxygen storage capacity corresponds to double the oxygen storage capacity of the SCR catalyst in a useful life state.

Thus, a method of operating an engine for a vehicle includes measuring a gas composition of an engine exhaust downstream of a selective catalytic reduction (SCR) catalyst with an exhaust gas sensor, calculating an oxygen storage capacity of the SCR catalyst based on the gas composition, and determining an extent of deactivation of the SCR from the oxygen storage capacity. In first example of the method, determining the extent of deactivation of the SCR catalyst is calculated based on the oxygen storage capacity relative to an oxygen storage capacity of the SCR catalyst in a fresh state. A second example of the method, optionally includes the first example, and further includes indicating a partially deactivated SCR catalyst in response to the oxygen storage capacity being greater than the oxygen storage capacity of the SCR catalyst in the fresh state. A third example of the method, optionally includes the first and second examples, and further includes wherein calculating the oxygen storage capacity of the SCR catalyst based on the gas composition is performed in response to an exhaust gas temperature exceeding a threshold exhaust gas temperature. A fourth example of the method, optionally includes the first through third examples, and further includes indicating a reversible deactivation based on the oxygen storage capacity of the SCR being greater than the oxygen storage capacity of the SCR in the fresh state in response to the exhaust gas temperature being below the threshold exhaust gas temperature. A fifth example of the method, optionally includes the first through fourth examples, and further includes indicating an irreversible deactivation based on the oxygen storage capacity of the SCR being greater than the oxygen storage capacity of the SCR in the fresh state in response to the exhaust gas temperature being above the threshold exhaust gas temperature.

In another representation, the method optionally includes the first through fifth examples, and further includes wherein calculating the oxygen storage capacity of the SCR catalyst based on the gas composition is performed in response to a threshold duration elapsing since last calculating the oxygen storage capacity.

In another representation, the method includes indicating an irreversible deactivation based on the oxygen storage capacity of the SCR being greater than the oxygen storage capacity of the SCR in the fresh state in response to the exhaust gas temperature being above the threshold exhaust gas temperature beyond a threshold deactivation duration. In another representation, the method includes, wherein the threshold exhaust gas temperature and the threshold deactivation duration are interdependent, wherein the threshold deactivation duration increases when the threshold exhaust gases temperature decreases. In another representation, in response to an SCR deactivation extent increasing beyond a lower threshold SCR deactivation extent, adjusting engine operating conditions to increase opportunities for regeneration of the SCR catalyst, including increasing a proportion of highway driving as compared to city driving or increasing leaner air-to-fuel engine operation.

Turning now to FIG. 6, it illustrates an example timeline 600 representing vehicle operation according to the methods described herein and with reference to FIGS. 3, 4, and 5, and as applied to the systems described herein and with reference to FIGS. 1 and 2. Timeline 600 includes trend line 610, indicating the exhaust temperature, $T_{exhaust}$, as well as an upper threshold exhaust temperature 612, over time. $T_{exhaust}$ may be measured by exhaust temperature sensor 158. Timeline 600 further includes plot 620, indicating an exhaust gas composition signal, over time. The exhaust gas composition signal may be measured by one or more of exhaust gas composition sensors 128, 225, 226 and/or 227. Timeline 600 further includes plot 630, indicating a baseline oxygen storage capacity, and plot 636, indicating an instantaneous oxygen storage capacity 636, as well as upper and lower threshold oxygen storage capacities 632 and 634 respectively, over time. Timeline 600 further includes plot 640, indicating $\lambda$, as well as $\lambda_{stoich}$ 642 and $\lambda_{TH}$, a lower threshold $\lambda$ 648, over time. $\lambda$ may be inferred and/or calculated based on various engine operating conditions such as intake air flow, fuel injection rate, spark timing, exhaust gas temperature, exhaust gas composition, and the like. $\lambda_{TH}$ may correspond to a threshold value of $\lambda$ below which the air-to-fuel ratio is rich enough to facilitate reduction of the copper ion in the SCR catalyst to a less positive oxidation state. Timeline 600 further includes plot 650 corresponding to an SCR evaluation condition being met. Controller 12 may determine when an SCR evaluation condition is met according to method 400 at 410. Timeline 600 further includes plot 660, indicating a baseline SCR deactivation extent, and plot 666, indicating an instantaneous SCR deactivation extent, as well as an upper threshold SCR deactivation extent 662 and a lower threshold SCR deactivation extent 664. When the SCR deactivation extent is greater than an upper threshold SCR deactivation extent, the SCR catalyst may be fully deactivated. In contrast, the SCR deactivation extent being below the lower threshold SCR deactivation extent may correspond to a fresh SCR catalyst. Also shown on timeline 600 is a threshold duration 698, $\Delta t_{TH}$.

Prior to time $t_1$ corresponds to a period when the SCR catalyst is fresh, as indicated by the baseline SCR deactivation extent being lower than the lower threshold SCR deactivation extent. $T_{exhaust}$ is less than an upper threshold exhaust temperature 612, and $\lambda$ is above $\lambda_{TH}$. As such, the SCR evaluation condition 650 is met and the exhaust gas composition is measured intermittently corresponding to each instance after a threshold duration 698, $\Delta t_{TH}$, has elapsed. The changing engine operating conditions with time generate a variable exhaust gas composition signal 620 with time. In one example, the exhaust gas composition signal may correspond to an exhaust gas oxygen concentration. Accordingly, as the exhaust gas composition signal rises and falls, an inferred instantaneous OSC 636 of the SCR catalyst rises and falls. Since $T_{exhaust}<T_{exhaust,TH}$, the variation in OSC may correspond to reversible changes in the oxygen storage capacity at the SCR catalyst, due to reversible reduction of $Cu^{2+}$ to $Cu^{1+}$ thereat. As such, the baseline OSC 630 of the SCR catalyst remains below the third threshold OSC, indicating a fresh SCR catalyst. Similarly, although the instantaneous SCR deactivation extent 666 of the SCR catalyst rises and falls (as determined from the instantaneous OSC 636), a baseline SCR deactivation extent 660 remains unchanged below the lower threshold SCR deactivation extent 664.

During the period between time $t_1$ and time $t_2$, λ decreases below $\lambda_{TH}$, and the SCR evaluation condition 650 is met. As such, the controller 12 measures the exhaust gas composition more frequently (e.g., more continuously as compared to measuring after $\Delta t_{TH}$ elapses), to more closely monitor the OSC 630 of the SCR catalyst. Similar to the time prior to $t_1$, as the exhaust gas composition signal rises and falls, an inferred instantaneous OSC 636 of the SCR catalyst rises and falls. Since $T_{exhaust}<T_{exhaust,TH}$, the variation in OSC may correspond to reversible changes in the oxygen storage capacity at the SCR catalyst, due to reversible reduction of $Cu^{2+}$ to $Cu^{1+}$ thereat. As such, the baseline OSC 630 of the SCR catalyst remains below the third threshold OSC, indicating a fresh SCR catalyst. Similarly, although the instantaneous SCR deactivation extent 666 of the SCR catalyst rises and falls (as determined from the instantaneous OSC 636), a baseline SCR deactivation extent 660 remains unchanged below the lower threshold SCR deactivation extent 664.

At time $t_2$, $T_{exhaust}$ increases above $T_{exhaust,TH}$, λ remains below $\lambda_{TH}$, and the SCR evaluation condition 650 is met. The controller 12 measures the exhaust gas composition more frequently to more closely monitor the OSC 630 of the SCR catalyst. In contrast to prior to time $t_2$, since $T_{exhaust}>T_{exhaust,TH}$, the positive increases in OSC 630 of the SCR catalyst reflect irreversible reduction of the copper ion to copper metal thereat. As such, the baseline OSC 630 of the SCR catalyst (and the instantaneous OSC 636) increases beyond the third threshold OSC steadily until time $t_3$. Accordingly, the baseline SCR deactivation extent 660 (and the instantaneous SCR deactivation extent 666) also increase steadily until time $t_3$. Thus, after time $t_2$, the SCR catalyst deactivation extent is partially deactivated and no longer fresh.

At time $t_3$, $T_{exhaust}$ decreases below $T_{exhaust,TH}$ and λ increases above $\lambda_{TH}$. As such, the SCR evaluation condition 650 is met and the exhaust gas composition is measured intermittently corresponding to each instance after a threshold duration 698, $\Delta t_{TH}$, has elapsed. Similar to the time prior to $t_1$, the changing engine operating conditions with time generate a variable exhaust gas composition signal 620 with time. Accordingly, as the exhaust gas composition signal rises and falls, an inferred instantaneous OSC 636 of the SCR catalyst rises and falls. Since $T_{exhaust}<T_{exhaust,TH}$, the variation in OSC may correspond to reversible changes in the oxygen storage capacity at the SCR catalyst, due to reversible reduction of $Cu^{2+}$ to $Cu^{1+}$ thereat. As such, the baseline OSC 630 of the SCR catalyst remains constant above the third threshold OSC and below the first threshold OSC, indicating a partially deactivated SCR catalyst. Similarly, although the instantaneous SCR deactivation extent 666 of the SCR catalyst rises and falls (as determined from the instantaneous OSC 636), a baseline SCR deactivation extent 660 remains unchanged between the lower threshold SCR deactivation extent 664 and the upper threshold SCR deactivation extent 662, indicative of a partially deactivated SCR catalyst.

Next, at time $t_4$, $T_{exhaust}$ increases above $T_{exhaust,TH}$, λ decreases below $\lambda_{TH}$, and the SCR evaluation condition 650 is met. The controller 12 measures the exhaust gas composition more frequently to more closely monitor the OSC 630 of the SCR catalyst. Since $T_{exhaust}>T_{exhaust,TH}$, the increases in OSC 630 of the SCR catalyst reflect irreversible reduction of the copper ion to copper metal thereat. As such, the baseline OSC 630 of the SCR catalyst (and the instantaneous OSC 636) increases steadily until time $t_5$. Accordingly, the baseline SCR deactivation extent 660 (and the instantaneous SCR deactivation extent 666) also increase steadily until time $t_5$.

At time $t_5$, the calculated OSC of the SCR catalyst increases to the first threshold OSC, and the SCR deactivation extent determined therefrom reaches the upper threshold SCR deactivation extent, indicating a fully deactivated SCR catalyst. In response, the controller 12 may transmit a notification to the vehicle operator of the deactivated SCR catalyst and to service the ECD 178. Furthermore, controller 12 may responsively adjust the engine operation to mitigate engine emissions in light of the deactivated SCR catalyst. As one example, the controller 12 may reduce a frequency of TFSO events to reduce a likelihood of $NH_3$ and/or NOx break through. After time $t_5$, $T_{exhaust}$ decreases below $T_{exhaust,TH}$, and λ increases above $\lambda_{TH}$. As such, the SCR evaluation condition 650 is met and the exhaust gas composition is measured intermittently corresponding to each instance after a threshold duration 698, $\Delta t_{TH}$, has elapsed.

Thus, an engine system includes an engine, an exhaust gas sensor positioned at an engine exhaust, downstream from a selective catalytic reduction (SCR) catalyst, and a controller, including executable instructions stored in non-transitory memory thereat to, determine an oxygen storage capacity of the SCR catalyst based on a measurement of the exhaust gas sensor, and indicate an extent of deactivation of the SCR catalyst based on the oxygen storage capacity. In a first example, the system includes wherein the exhaust gas sensor includes an exhaust gas oxygen sensor. In a second example, the system optionally includes the first example, and further includes wherein the exhaust gas sensor includes a NOx/$NH_3$ sensor. In a third example, the system optionally includes the first and second examples, and further includes a second exhaust gas sensor positioned upstream of the SCR catalyst, wherein the executable instructions to determine the oxygen storage capacity of the SCR catalyst are based on the measurement of the exhaust gas sensor and a measurement of the second exhaust gas sensor. In a fourth example, the system optionally includes the first through third examples, and further includes wherein the SCR catalyst includes a copper zeolite catalyst. In a fifth example, the system optionally includes the first through fourth examples, and further includes wherein the executable instructions further comprise determining the oxygen storage capacity of the SCR catalyst based on the measurement of the exhaust gas sensor in response to an exhaust gas temperature exceeding a threshold exhaust temperature.

In this way, the technical effect of reliably diagnosing SCR catalyst deactivation can be achieved, while reducing exhaust emissions and reducing vehicle costs. For example, an engine controller may advantageously adjust engine operation responsive to a timely diagnosis of SCR catalyst deactivation by reducing a frequency of TFSO and other engine operating modes and events in order to reduce a proclivity for breakthrough of emissions such as NOx and $NH_3$ at the deactivated SCR catalyst. Furthermore, the controller may aid in notifying and recommending servicing of an ECD, including an SCR catalyst, to a vehicle operator in a timely manner so as to decrease engine operation during a period when the SCR catalyst is deactivated, thereby reducing engine emissions. Further still, by inferring an SCR catalyst deactivation extent from exhaust gas temperature and oxygen sensors, a cost of manufacturing, operation, and maintenance of a vehicle can be reduced.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating an engine comprising:

positioning an oxygen sensor in an engine exhaust downstream from a selective catalytic reduction (SCR) catalyst, determining an oxygen storage capacity (OSC) of the SCR catalyst based on a measurement of the oxygen sensor, determining an extent of deactivation of the SCR catalyst based on the OSC, and regenerating the SCR catalyst responsive to the OSC of the SCR catalyst increasing above a second threshold OSC, including operating the engine at a lean exhaust air-fuel ratio.

2. The method of claim 1, wherein determining the OSC of the SCR catalyst is in response to a first condition being met, the first condition including when an exhaust gas temperature is greater than a threshold exhaust temperature, wherein the threshold exhaust temperature includes a sintering temperature of the SCR catalyst.

3. The method of claim 1, wherein determining the OSC of the SCR catalyst is in response to a first condition being met, the first condition including when an air-fuel ratio is below a threshold air-fuel ratio.

4. The method of claim 1, further comprising indicating a degraded SCR catalyst in response to an increase in the OSC the SCR catalyst beyond the second threshold OSC.

5. The method of claim 4, wherein the second threshold OSC corresponds to twice an oxygen storage capacity of the SCR catalyst in a full useful life state.

6. The method of claim 1, further comprising indicating irreversible deactivation of the SCR catalyst responsive to the OSC of the SCR catalyst remaining above the second threshold OSC after regenerating the SCR catalyst.

7. The method of claim 6, further comprising indicating reversible deactivation of the SCR catalyst responsive to the OSC of the SCR catalyst decreasing below the second threshold OSC after regenerating the SCR catalyst.

8. The method of claim 1, wherein the second threshold OSC corresponds to the OSC of the SCR catalyst at a full useful life state.

9. The method of claim 1, wherein determining the OSC of the SCR catalyst is performed in response to a first condition being met, the first condition including when an elapsed duration since last determining the OSC of the SCR catalyst increases beyond a threshold duration.

10. The method of claim 9, wherein the threshold duration decreases as the extent of deactivation of the SCR catalyst increases.

11. An engine system for a vehicle, including:

an engine, an exhaust gas sensor positioned at an engine exhaust, downstream from a selective catalytic reduction (SCR) catalyst, and a controller, including executable instructions stored in non-transitory memory thereat to, determine an oxygen storage capacity (OSC) of the SCR catalyst based on a measurement of the exhaust gas sensor, indicate an extent of deactivation of the SCR catalyst based on the OSC, and regenerate the SCR catalyst responsive to the OSC of the SCR catalyst increasing above a second threshold OSC, including operating the engine at a lean exhaust air-fuel ratio.

12. The engine system of claim 11, wherein the exhaust gas sensor includes a $NOx/NH_3$ sensor.

13. The system of claim 11, wherein the executable instructions further comprise notifying an operator of the vehicle responsive to the extent of deactivation of the SCR catalyst being greater than a threshold extent of deactivation.

14. A method of operating an engine for a vehicle, including:

measuring a gas composition of an engine exhaust, calculating an oxygen storage capacity (OSC) of an SCR catalyst based on the measured gas composition, determining an extent of deactivation of the SCR catalyst from the OSC, and regenerating the SCR catalyst responsive to the OSC of the SCR catalyst increasing above a second threshold OSC, including operating the engine at a lean exhaust air-fuel ratio.

15. The method of claim 14, wherein determining the extent of deactivation of the SCR catalyst is calculated based on the OSC relative to an OSC of the SCR catalyst in a fresh state.

16. The method of claim 15, wherein calculating the OSC of the SCR catalyst based on the gas composition is performed in response to an exhaust gas temperature exceeding a threshold exhaust gas temperature, wherein the threshold exhaust gas temperature corresponds to a sintering temperature of the SCR catalyst.

17. The method of claim 16, further comprising indicating a reversible change in the extent of deactivation of the SCR responsive to the OSC of the SCR catalyst increasing above the OSC of the SCR catalyst in the fresh state while the exhaust gas temperature is below the threshold exhaust gas temperature.

18. The method of claim 16, further comprising indicating an irreversible change in the extent of deactivation of the SCR responsive to the OSC of the SCR catalyst increasing above the OSC of the SCR catalyst in the fresh state while the exhaust gas temperature is above the threshold exhaust gas temperature.

19. The method of claim 18, wherein the irreversible change in the extent of deactivation of the SCR catalyst is indicated responsive to the OSC of the SCR catalyst increasing above the OSC of the SCR catalyst in the fresh state while the exhaust gas temperature is above the threshold exhaust gas temperature for a threshold deactivation duration.

20. The method of claim 19, wherein the threshold exhaust gas temperature is lower when the threshold deactivation duration is longer, and the threshold exhaust gas temperature is higher when the threshold deactivation duration is shorter.

* * * * *